US010021942B2

(12) United States Patent
Conrad et al.

(10) Patent No.: US 10,021,942 B2
(45) Date of Patent: Jul. 17, 2018

(54) FOOTWEAR LACING SYSTEM

(71) Applicant: NIKE, Inc., Beaverton, OR (US)

(72) Inventors: Bryan P. Conrad, Lake Oswego, OR (US); Amy Lyttle, Portland, OR (US); Billy McFarland, Portland, OR (US); Phuc Nguyen, Portland, OR (US); Erin Toraya, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 264 days.

(21) Appl. No.: 14/481,365

(22) Filed: Sep. 9, 2014

(65) Prior Publication Data

US 2015/0040430 A1 Feb. 12, 2015

Related U.S. Application Data

(63) Continuation-in-part of application No. 13/627,515, filed on Oct. 6, 2011, now Pat. No. 8,844,168.

(51) Int. Cl.

| | |
|---|---|
| ***A43C 11/00*** | (2006.01) |
| ***A43C 9/00*** | (2006.01) |
| ***A43C 1/00*** | (2006.01) |
| ***A43C 7/00*** | (2006.01) |

(52) U.S. Cl.

CPC ..... *A43C 9/00* (2013.01); *A43C 1/00* (2013.01); *A43C 1/006* (2013.01); *A43C 7/00* (2013.01); *A43C 7/005* (2013.01); *Y10T 24/37* (2015.01); *Y10T 24/3737* (2015.01)

(58) Field of Classification Search

CPC .. A43C 9/00; A43C 7/005; A43C 1/00; A43C 1/006; A43C 7/00; A43C 5/00; Y10T 24/37; Y10T 24/3737

USPC ..... 36/50.1

See application file for complete search history.

(56) References Cited

U.S. PATENT DOCUMENTS

| | | | | |
|---|---|---|---|---|
| 716,528 A | | 12/1902 | Flowers | |
| 841,419 A | * | 1/1907 | Molkenbur | A43C 7/00 24/129 B |
| 879,272 A | | 2/1908 | Key | |
| 1,340,503 A | | 5/1920 | Schopper | |

(Continued)

FOREIGN PATENT DOCUMENTS

| | | |
|---|---|---|
| WO | 0035308 A2 | 6/2000 |
| WO | 2016039879 A1 | 3/2016 |

OTHER PUBLICATIONS

International Search Report and the Written Opinion for Application No. PCT/US2015/042432, dated Dec. 15, 2015, 20 pages.

*Primary Examiner* — Katharine Gracz
(74) *Attorney, Agent, or Firm* — Quinn IP Law

(57) ABSTRACT

A lacing system for an article of footwear may include a lateral series of lace-receiving elements and a medial series of lace-receiving elements. A first lace extends consecutively through a first lateral lace-receiving element, a second lateral lace-receiving element, a fourth medial lace-receiving element, a fifth lateral lace-receiving element, a third medial lace-receiving element, and again through the first lateral lace-receiving element. A second lace extends consecutively through a first medial lace-receiving element, a second medial lace-receiving element, a fourth lateral lace-receiving element, a fifth medial lace-receiving element, a third lateral lace-receiving element, and again through the first medial lace-receiving element.

13 Claims, 22 Drawing Sheets

(56) References Cited

U.S. PATENT DOCUMENTS 1,384,565 A * 7/1921 Martin ..... A43C 5/00 135/119
1,730,462 A * 10/1929 Jaques ..... A43C 7/005 24/191
3,176,362 A * 4/1965 Tames ..... A43C 7/005 24/712.2
3,458,368 A 7/1969 Haberecht
3,526,977 A 9/1970 Partagas
3,546,796 A 12/1970 Adams
3,548,798 A 12/1970 Fleischer et al.
3,676,883 A * 7/1972 Peacock ..... D05B 85/00 12/142 MC
3,703,775 A 11/1972 Gatti
3,710,486 A 1/1973 Revny
3,837,098 A 9/1974 Rathmell
3,934,346 A 1/1976 Sasaki et al.
4,200,998 A 5/1980 Adams
4,245,408 A * 1/1981 Larsen ..... A43C 11/004 36/114
4,282,659 A 8/1981 Bourque et al.
RE31,052 E 10/1982 Adams
4,442,613 A 4/1984 Dobbin
4,458,373 A 7/1984 Maslow
4,547,981 A 10/1985 Thais et al.
4,622,763 A 11/1986 Adams
4,651,447 A * 3/1987 Sullivan ..... A43B 1/0036 24/715.4
4,856,207 A 8/1989 Datson
4,942,678 A 7/1990 Gumbert
4,972,609 A 11/1990 Oh et al.
4,972,613 A 11/1990 Loveder
5,022,127 A * 6/1991 Ang ..... A43C 7/005 24/712.2
5,074,013 A * 12/1991 Arnold ..... A43B 1/0072 24/306
5,158,428 A 10/1992 Gessner et al.
5,291,671 A 3/1994 Caberlotto et al.
5,371,957 A 12/1994 Gaudio
5,511,325 A 4/1996 Hieblinger
5,657,557 A 8/1997 Hull et al.
D385,043 S 10/1997 Worthington
5,678,325 A 10/1997 Davidowitz et al.
5,755,044 A 5/1998 Veylupek
5,884,419 A 3/1999 Davidowitz et al.
5,943,793 A 8/1999 Clements
6,088,936 A 7/2000 Bahl
6,192,559 B1 2/2001 Munsell, Jr.
6,282,817 B1 * 9/2001 Curet ..... A43C 7/04 24/712.1
6,286,233 B1 9/2001 Gaither
6,338,186 B1 1/2002 Kleinmann
6,370,743 B2 4/2002 Choe et al.
6,502,329 B1 1/2003 Silagy
6,532,688 B2 3/2003 Bouvier
6,823,610 B1 11/2004 Ashley
6,941,683 B2 9/2005 Freed
6,952,890 B1 10/2005 Blakeslee
7,908,769 B2 3/2011 Pellegrini
7,987,617 B2 * 8/2011 Kohatsu ..... A43B 3/14 36/1
8,146,271 B2 * 4/2012 Friton ..... A43C 1/00 24/712.1
2002/0002781 A1 1/2002 Bouvier
2003/0051374 A1 3/2003 Freed
2004/0078999 A1 4/2004 Freed
2006/0005429 A1 * 1/2006 Min ..... A43C 1/003 36/50.1
2006/0265878 A1 * 11/2006 Zorman ..... A44C 5/0053 29/896.411
2008/0127511 A1 6/2008 Friton
2009/0038128 A1 * 2/2009 Cho ..... A43C 7/00 24/68 SK
2009/0100707 A1 * 4/2009 Bar ..... A43C 11/008 36/50.1
2011/0255808 A1 * 10/2011 Bowman ..... A45C 13/26 383/72
2013/0019501 A1 * 1/2013 Gerber ..... A43C 1/04 36/50.1
2013/0086815 A1 4/2013 Toraya

* cited by examiner

FOOTWEAR LACING SYSTEM

CROSS REFERENCE TO RELATED APPLICATIONS

This application is a continuation-in-part of U.S. Patent Publication No. 2013/0086815, filed Oct. 6, 2011 and published on Apr. 11, 2013, the entirety of which is hereby incorporated by reference.

BACKGROUND

Articles of footwear generally include two primary elements: an upper and a sole structure. The upper is often formed from a plurality of material elements (e.g., textiles, polymer sheet layers, polymer foam layers, leather, synthetic leather) that are stitched or adhesively bonded together to form a void within the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear, and the upper may incorporate a heel counter for stabilizing the heel area of the foot.

The sole structure is secured to a lower portion of the upper and positioned between the foot and the ground. In athletic footwear, for example, the sole structure often includes a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. In some configurations, the midsole may be primarily formed from a fluid-filled chamber. The outsole forms a ground-contacting element of the footwear and is usually fashioned from a durable and wear-resistant rubber material that includes texturing to impart traction. The sole structure may also include a sockliner positioned within the void of the upper and proximal a lower surface of the foot to enhance footwear comfort.

SUMMARY

In one aspect, a lacing system for an article of footwear may have a first series of lace-receiving elements extending in a longitudinal direction of the footwear. The lacing system may also have a second series of lace-receiving elements extending in the longitudinal direction of the footwear, the second series being spaced from the first series. A first lace extends through (a) two of the lace-receiving elements of the first series that are consecutive and (b) two of the lace-receiving elements of the second series that are consecutive. Additionally, a second lace extends through (a) two of the lace-receiving elements of the second series that are consecutive and (b) two of the lace-receiving elements of the first series that are consecutive.

In another aspect, a lacing system for an article of footwear may have a first series of lace-receiving elements extending in a longitudinal direction of the footwear. The lacing system may also have a second series of lace-receiving elements extending in the longitudinal direction of the footwear, the second series being spaced from the first series. A first lace extends through three of the lace-receiving elements of the first series and two of the lace-receiving elements of the second series. Additionally, a second lace extends through three of the lace-receiving elements of the second series and two of the lace-receiving elements of the first series.

In yet another aspect, a lacing system for an article of footwear may include a plurality of lace-receiving elements. A first lace has two first end lengths and a first central length. The first end lengths are parallel and joined to each other. The first central length is located between the first end lengths and forms a first loop. The first central length extends through a first set of the lace-receiving elements. A second lace has two second end lengths and a second central length. The second end lengths are parallel and joined to each other. The second central length is located between the second end lengths and forms a second loop. The second central length extends through a second set of the lace-receiving elements.

In a further aspect, a lacing system for an article of footwear may include a plurality of lace-receiving elements. The lace-receiving elements extend through a throat area of the upper and include (a) a first lace-receiving element positioned proximal to an ankle opening of the upper and (b) a second lace-receiving element that is spaced from the first lace-receiving element and positioned proximal to the ankle opening. A first lace extends through a portion of the lace-receiving elements, and two segments of the first lace extend through the first lace-receiving element. A second lace extends through another portion of the lace-receiving elements, and two segments of the second lace extend through the second lace-receiving element.

In another aspect, a lacing system for an article of footwear may include a lateral series of lace-receiving elements and a medial series of lace-receiving elements. The lateral series is located in a lateral portion of the footwear and includes a first lateral lace-receiving element positioned proximal to an ankle opening of the upper, a second lateral lace-receiving element positioned forward of the first lateral lace-receiving element, a third lateral lace-receiving element positioned forward of the second lateral lace-receiving element, a fourth lateral lace-receiving element positioned forward of the third lateral lace-receiving element, and a fifth lateral lace-receiving element positioned forward of the fourth lateral lace-receiving element. The medial series is located in a medial portion of the footwear and includes a first medial lace-receiving element positioned proximal to an ankle opening of the upper, a second medial lace-receiving element positioned forward of the first medial lace-receiving element, a third medial lace-receiving element positioned forward of the second medial lace-receiving element, a fourth medial lace-receiving element positioned forward of the third medial lace-receiving element, and a fifth medial lace-receiving element positioned forward of the fourth medial lace-receiving element. A first lace extends consecutively through the first lateral lace-receiving element, the second lateral lace-receiving element, the fourth medial lace-receiving element, the fifth lateral lace-receiving element, the third medial lace-receiving element, and the first lateral lace-receiving element. A second lace extends consecutively through the first medial lace-receiving element, the second medial lace-receiving element, the fourth lateral lace-receiving element, the fifth medial lace-receiving element, the third lateral lace-receiving element, and the first medial lace-receiving element.

In another aspect, an article of footwear may have an upper and a sole structure. The upper may include a lacing system comprising a first series of lace-receiving elements extending in a longitudinal direction of the footwear. The lacing system may include a second series of lace-receiving elements extending in the longitudinal direction of the footwear. The second series may be spaced from and parallel to the first series. The lacing system may include a first lace that comprises a first lace element and a second lace element that is parallel and coextensive with the first lace element. The first lace may have a first terminal end and a second terminal end opposite the first terminal end. The first lace element and second lace element may converge to form a unitary lace segment defining an end length of the first lace disposed adjacent to the first terminal end of the first lace. The first lace element of the first lace may extend through a topmost lace-receiving element of the first series of lace-receiving elements located adjacent to an ankle opening of the upper and the second lace element of the first lace may extend through a lace-receiving element of the first series of lace-receiving elements that is consecutive with the topmost lace-receiving element of the first series of lace-receiving elements.

In another aspect, an article of footwear may have an upper and a sole structure. The upper may include a lacing system comprising a first series of lace-receiving elements extending in a longitudinal direction of the footwear. The lacing system may include a second series of lace-receiving elements extending in the longitudinal direction of the footwear. The second series may be spaced from and parallel to the first series. The lacing system may include a first lace that comprises a first lace element and a second lace element that is parallel and coextensive with the first lace element. The first lace may have a first terminal end and a second terminal end opposite the first terminal end. The first lace element and second lace element may be joined to form a unitary lace segment defining an end length of the first lace disposed adjacent to the first terminal end of the first lace. At a point disposed adjacent to the second terminal end of the first lace, the first lace element and the second lace element of the first lace may together extend through a bottommost lace-receiving element of the first series of lace-receiving elements. The lacing system may include a second lace that comprises a first lace element and a second lace element that is parallel and coextensive with the second lace element. The second lace may have a first terminal end and a second terminal end opposite the first terminal end. The first lace element and second lace element of the second lace may be joined to form a unitary lace segment defining an end length of the second lace disposed adjacent to the first terminal end of the second lace. At a point disposed adjacent to the second terminal end of the first lace, the first lace element and the second lace element of the second lace may together extend through a bottommost lace-receiving element of the second series of lace-receiving elements. The end length of the first lace and the end length of the second lace may be designed to be tied together into a bow tie.

In another aspect, a method of making a shoe lace for an article of footwear may include a step of providing a first lace element and a second lace element each having a first terminal end and a second terminal end opposite the first terminal end. The method may further include forming a unitary lace segment from which the first lace element and the second lace element extend, colletively forming a Y-shaped lace.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose a lacing system for an article of footwear. The article of footwear is presented as having a general configuration suitable for walking or running. Concepts associated with the footwear may also be applied to a variety of other athletic footwear types, including baseball shoes, basketball shoes, cross-training shoes, cycling shoes, football shoes, tennis shoes, and soccer shoes, for example. The concepts may also be applied to footwear types that are generally considered to be non-athletic, including dress shoes, loafers, and boots. The concepts disclosed herein apply, therefore, to a wide variety of footwear types and are not limited to the various configurations presented herein.

General Footwear Structure

Figure 1:
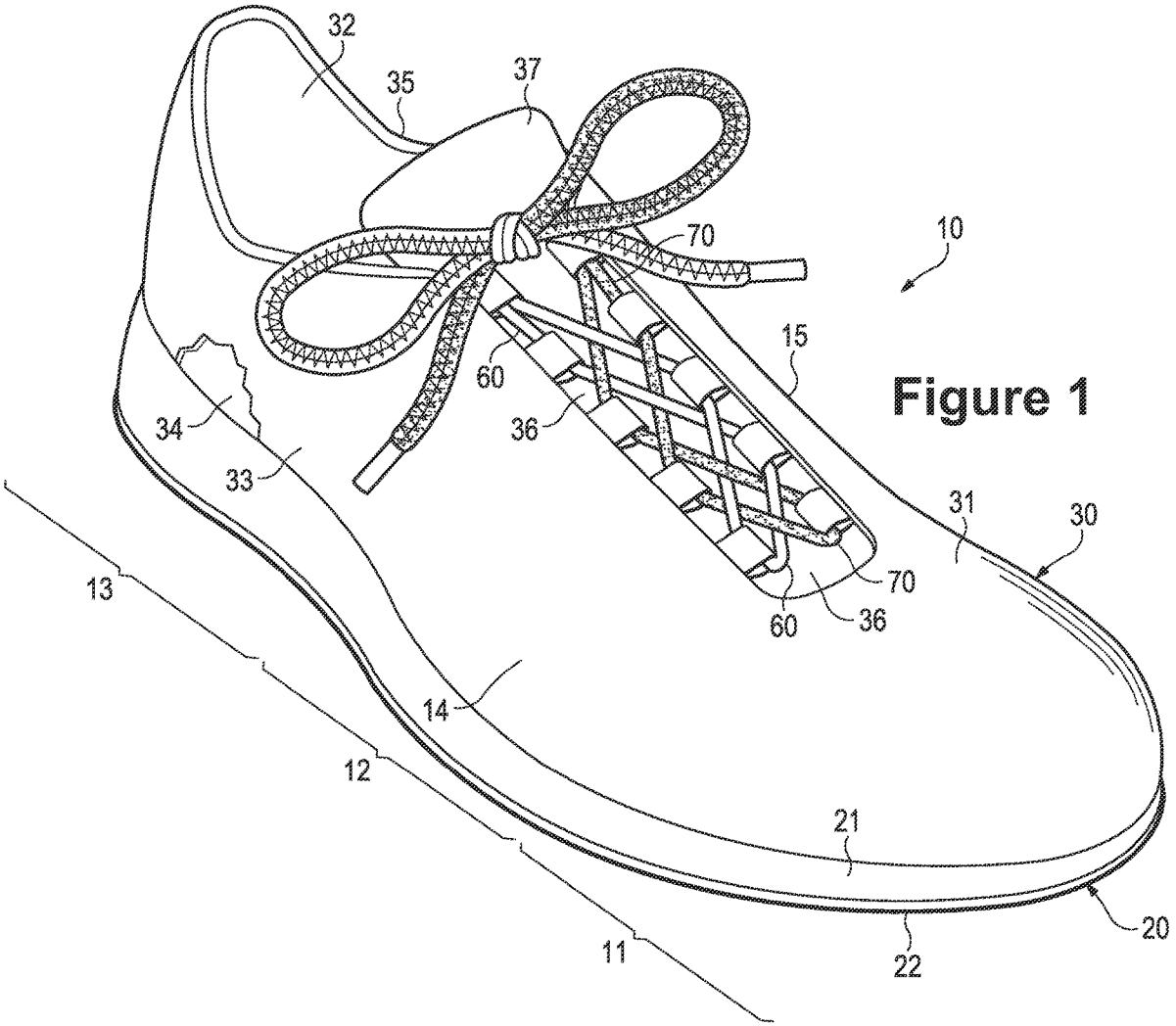
FIG. 1 is a perspective view of an article of footwear.

An article of footwear 10 is depicted in FIG. 1 as including a sole structure 20 and an upper 30. Sole structure 20 is secured to a lower area of upper 30 and extends between upper 30 and the ground. Upper 30 provides a comfortable and secure covering for a foot of a wearer. As such, the foot may be located within upper 30, which effectively secures the foot within footwear 10, and sole structure 20 extends under the foot to, for example, attenuate forces, enhance stability, or influence the motions of the foot.

For reference purposes, footwear 10 may be divided into three general regions: a forefoot region 11, a midfoot region 12, and a heel region 13. Forefoot region 11 generally includes portions of footwear 10 corresponding with the toes and the joints connecting the metatarsals with the phalanges. Midfoot region 12 generally includes portions of footwear 10 corresponding with an arch area of the foot. Heel region 13 generally corresponds with rear portions of the foot, including the calcaneus bone. Footwear 10 also includes a lateral side 14 and a medial side 15, which extend through each of regions 11-13 and correspond with opposite sides of footwear 10. More particularly, lateral side 14 corresponds with an outside area of the foot (i.e. the surface that faces away from the other foot), and medial side 15 corresponds with an inside area of the foot (i.e., the surface that faces toward the other foot). Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to sole structure 20, upper 30, and individual elements thereof.

Figure 4:
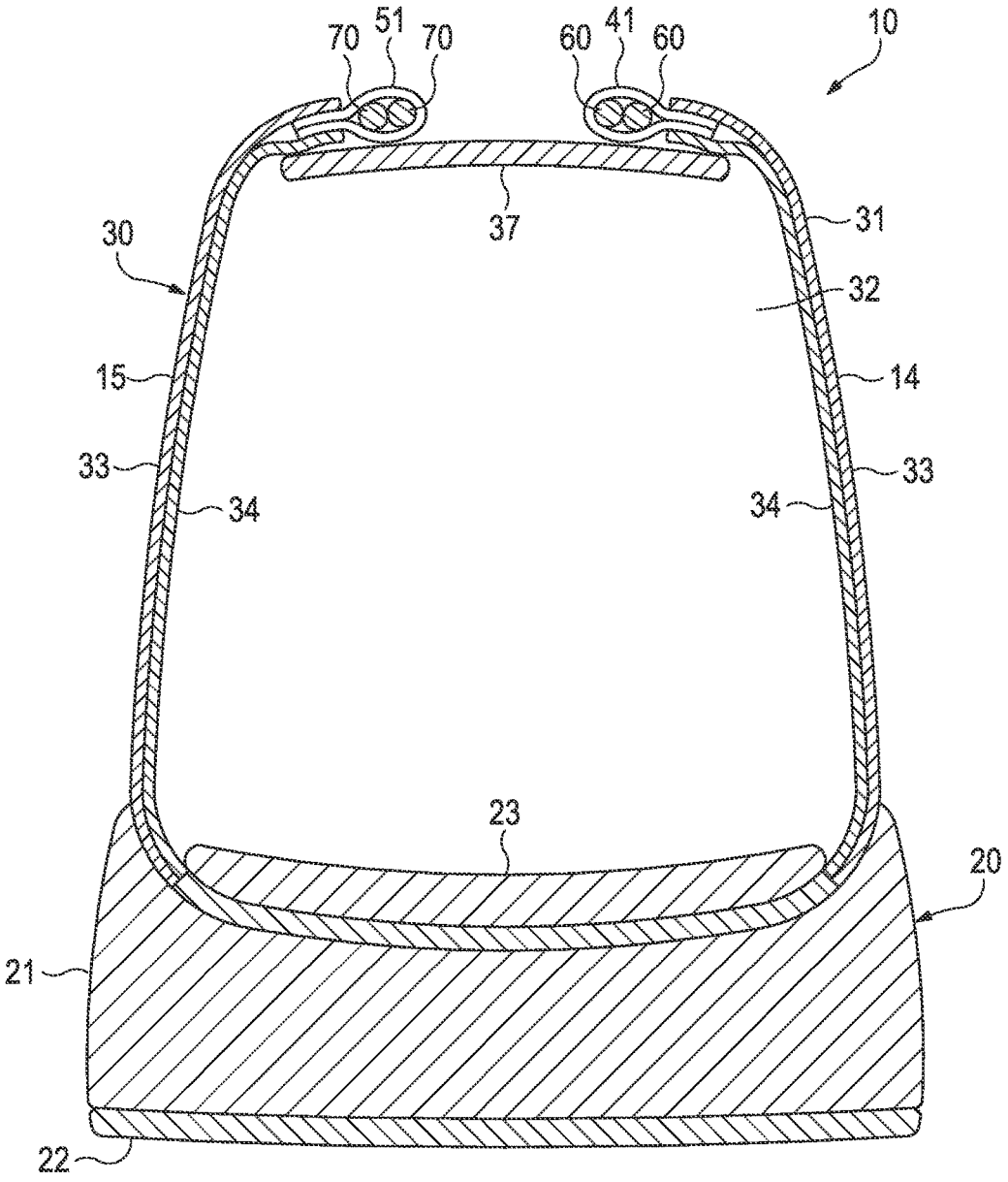
FIG. 4 is a cross-sectional view of the article of footwear, as defined by section line 4 in FIG. 3.
Figure 5:
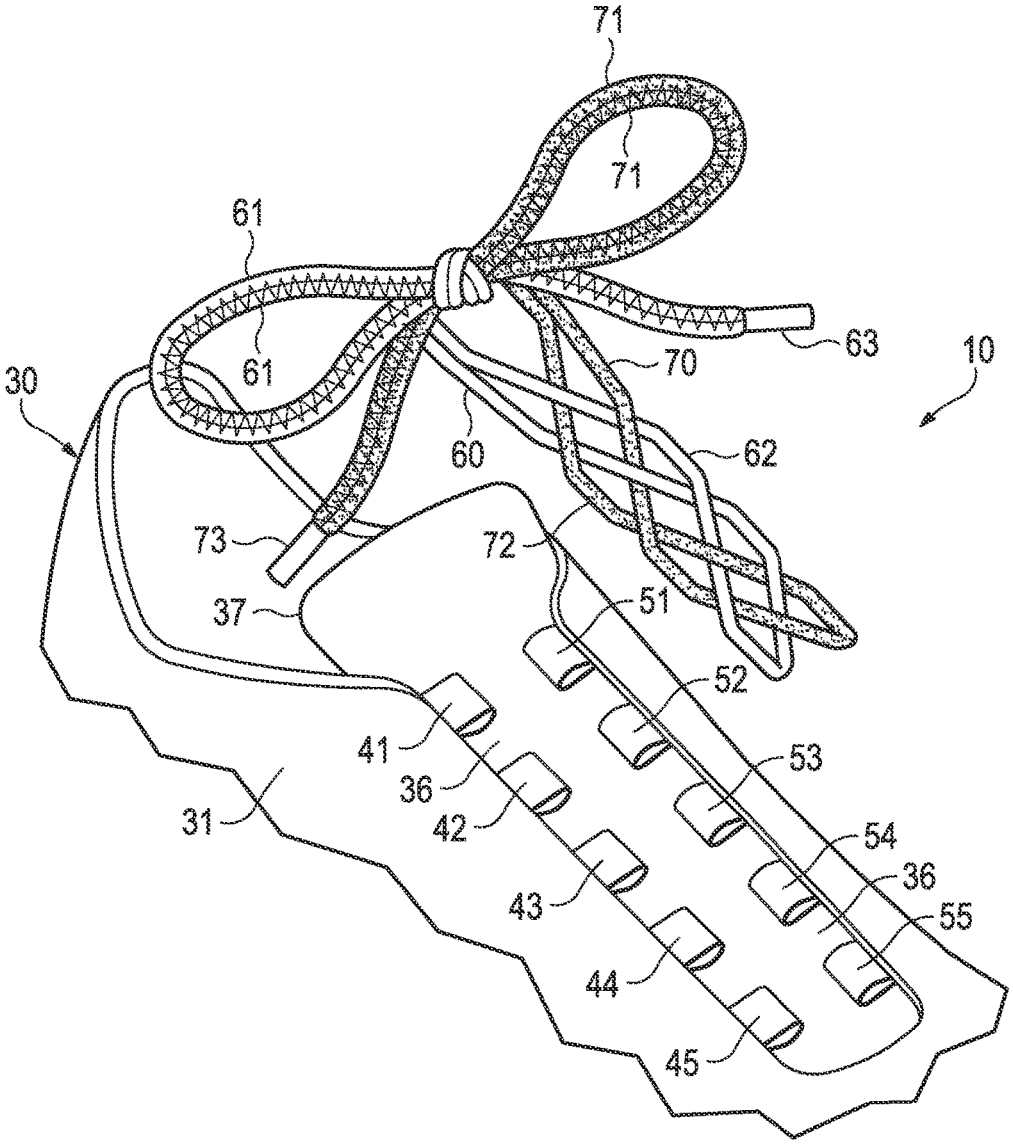
FIG. 5 is an exploded partial perspective view of the article of footwear.

Sole structure 20 includes a midsole 21, an outsole 22, and a sockliner 23. Midsole 21 is secured to a lower surface of upper 30 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 21 may incorporate fluid-filled chambers, plates, moderators, or other elements that further attenuate forces, enhance stability, or influence the motions of the foot, or midsole 21 may be primarily formed from a fluid-filled chamber. Outsole 22 is secured to a lower surface of midsole 21 and may be formed from a wear-resistant rubber material that is textured to impart traction. Sockliner 23 is located within upper 30, as depicted in FIG. 4, and is positioned to extend under a lower surface of the foot. Although this configuration for sole structure 20 provides an example of a sole structure that may be used in connection with upper 30, a variety of other conventional or nonconventional configurations for sole structure 20 may also be utilized. Accordingly, the structure and features of sole structure 20 or any sole structure utilized with upper 30 may vary considerably.

Upper 30, as noted above, is secured to sole structure 20 and provides a comfortable and secure covering for a foot of a wearer. A majority of upper 30 is formed from a covering element 31 that defines a portion of a void 32 within upper 30. Void 32 is a generally hollow area of footwear 10 that has a general shape of the foot and is intended to receive the foot. Covering element 31 extends (a) along a portion of void 32 in lateral side 14, (b) along a portion of void 32 in medial side 15, (c) over void 32 in a forefoot region 11, and (d) around void 32 in heel region 13. As such, covering element 31 effectively provides a covering for the foot. The various portions of covering element 31 may be formed from one or more of a plurality of material elements (e.g., textiles, polymer sheet layers, polymer foam layers, leather, synthetic leather) that are stitched or bonded together. Referring to FIG. 4, for example, covering element 31 includes an exterior layer 33 and an adjacent interior layer 34 that may be formed from any of the materials noted above. Whereas exterior layer 33 forms an exterior surface of upper 30, interior layer 34 is located inward of exterior layer 32 and forms an interior surface of upper 30, collectively defining a portion of void 32. Additionally, an upper edge of covering element 31 defines an ankle opening 35 in at least heel region 13 for providing the foot with access to void 34. In further configurations, covering element 31 may include (a) one or more additional layers, such as a central foam layer, (b) a heel counter that stabilizes a heel of the foot in heel region 13, or (c) a wear-resistant toe guard located in forefoot region 11. Although not depicted, indicia in the form of trademarks, for example, aesthetic features, and material and care information may also be secured to or printed on covering element 31 or other elements of upper 30.

Figure 2:
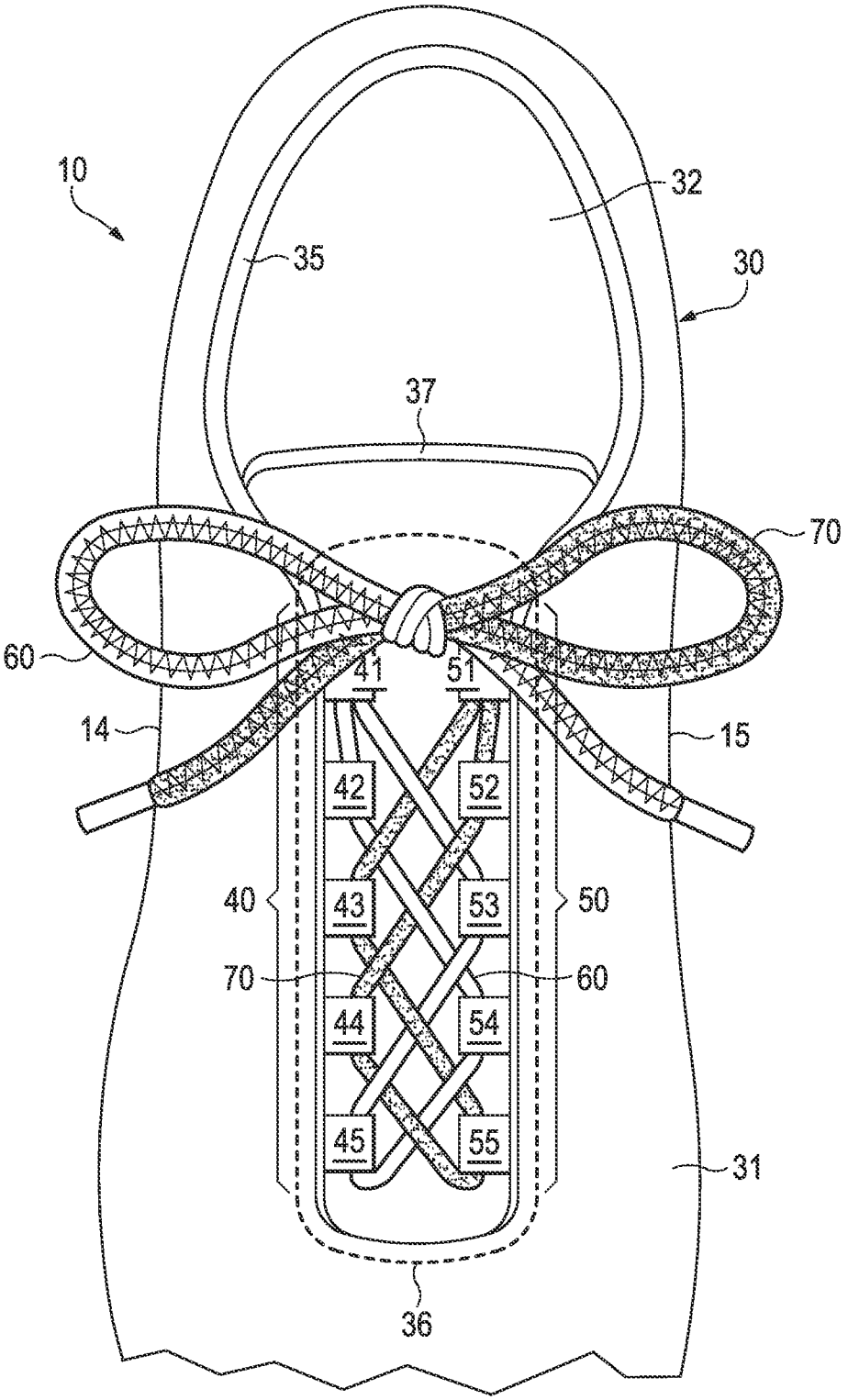
FIG. 2 is a top plan view of the article of footwear.
Figure 3:
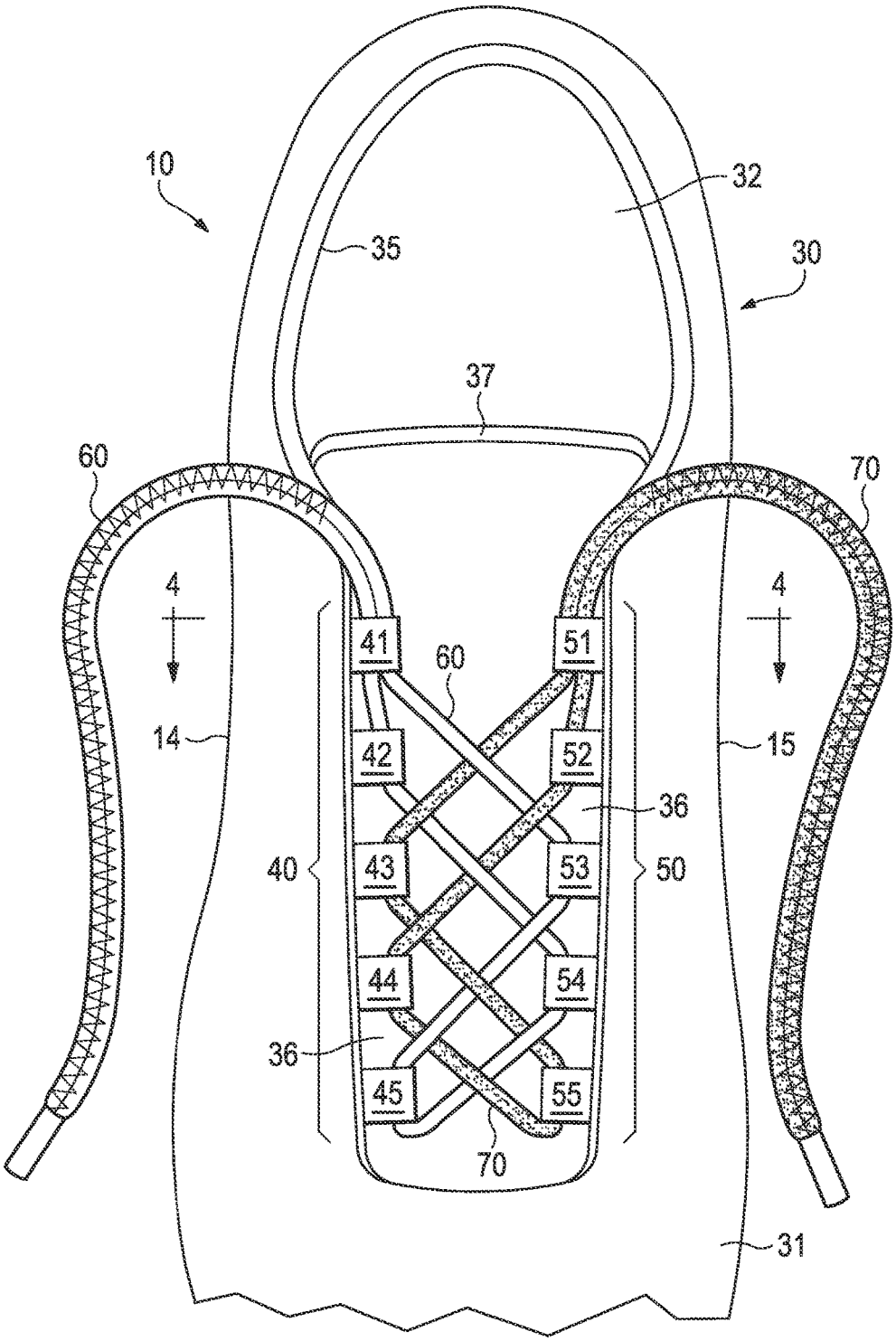
FIG. 3 is another top plan view of the article of footwear.

A portion of upper 30 that covers an instep of the foot includes a throat area 36 that is located in at least midfoot region 12. Although the extent of throat area 36 may vary depending upon the construction and style of footwear 10, throat area 36 generally extends between forefoot region 11 (or a forward area of midfoot region 12) and ankle opening 35, as shown in FIG. 2. In addition to a lacing system, which will be described in detail below, throat area 36 includes a tongue 37 that extends longitudinally (i.e. in a direction corresponding with a longitudinal axis of footwear 10 that passes through each of regions 11-13) through throat area 36. A lower surface of tongue 37 forms a portion of void 32 and contacts the foot when footwear 10 is worn. In some configurations, tongue 37 is secured to upper 30 in a forward portion of throat area 36. Although tongue 37 may have a variety of configurations, tongue 37 may be formed from a foam material that is surrounded by an exterior textile sheath, for example.

Lacing System Configuration

Upper 30 has a lacing system that includes a lateral series 40 of five lace-receiving elements 41-45, a medial series 50 of five lace-receiving elements 51-55, a first lace 60, and a second lace 70. The lacing system provides a wearer with the ability to selectively modify the dimensions of upper 30. More particularly, the wearer may utilize the lacing system to (a) enlarge the dimensions of void 32 and ankle opening 35 when placing footwear 10 upon the foot and removing footwear 10 from the foot and (b) decrease the dimensions of void 32 and ankle opening 35 to tighten upper 30 around the foot.

Lateral series 40 includes the various lace-receiving elements 41-45 and extends longitudinally through a portion of throat area 36 that generally corresponds with lateral side 14. Lace-receiving elements 41-45 are successively positioned on upper 30. More particularly, lace-receiving element 41 is located proximal to ankle opening 35 and rearward of the other lace-receiving elements 42-45, lace-receiving element 42 is positioned forward of lace-receiving element 41, lace-receiving element 43 is positioned forward of lace-receiving element 42, lace-receiving element 44 is positioned forward of lace-receiving element 43, and lace-receiving element 45 is positioned forward of lace-receiving element 44 and proximal to a forward portion of throat area 36.

Medial series 50 includes the various lace-receiving elements 51-55 and extends longitudinally through a portion of throat area 36 that generally corresponds with medial side 15. As such, lateral series 40 and medial series 50 are spaced from each other across a portion of throat area 36 where tongue 37 is exposed. Lace-receiving elements 51-55 are successively positioned on upper 30. More particularly, lace-receiving element 51 is located proximal to ankle opening 35 and rearward of the other lace-receiving elements 52-55, lace-receiving element 52 is positioned forward of lace-receiving element 51, lace-receiving element 53 is positioned forward of lace-receiving element 52, lace-receiving element 54 is positioned forward of lace-receiving element 53, and lace-receiving element 55 is positioned forward of lace-receiving element 54 and proximal to a forward portion of throat area 36.

Each of lace-receiving elements 41-45 and 51-55 are formed as a tubular structure with an axis extending in the longitudinal direction of footwear 10. As an example of the manner in which this tubular structure may be formed, each of lace-receiving elements 41-45 and 51-55 may have the configuration of a folded material element, as depicted in FIG. 4, with ends that are secured between layers 33 and 34. As alternatives, one or more of lace-receiving elements 41-45 and 51-55 may be another structure that is suitable for receiving one of laces 60 and 70, such as an aperture in covering element 31, a tubular structure, a D-ring, or a hook.

Laces 60 and 70 may be formed from conventional materials utilized in footwear laces. Moreover, laces 60 and 70 may be formed from any of a variety of elongate and flexible elements, such as a cord, rope, twine, filament, cable, thread, or yarn, for example. Although laces 60 and 70 are depicted as having a generally circular cross-sectional shape, laces 60 and 70 may also have an elongate, compressed, or otherwise non-circular shape.

Each of laces 60 and 70 pass through selected lace-receiving elements 41-45 and 51-55. The specific manner in which laces 60 and 70 are routed through the various lace-receiving elements 41-45 and 51-55 may be viewed in FIGS. 1, 2, 3, and 5. As depicted, first lace 60 extends consecutively (i.e., in order) through lace-receiving element 41, lace-receiving element 42, lace-receiving element 54, the lace-receiving element 45, lace-receiving element 53, and again through lace-receiving element 41. Given this routing, first lace 60 passes twice through lace-receiving element 41, but only passes once through each of lace-receiving elements 42, 45, 53, and 54. That is, two segments (i.e., separate sections or portions) of first lace 60 extend through lace-receiving element 41. Another feature of this routing is that first lace 60 extends through (a) two consecutive lace-receiving elements 41 and 42 of lateral series 40 and (b) two consecutive lace-receiving elements 53 and 54 of medial series 50. Furthermore, a feature of this routing is that first lace 60 extends through three lace-receiving elements 41, 42, and 45 of lateral series 40 and two lace-receiving elements 53 and 54 of medial series 50.

Second lace 70 is routed similarly to first lace 60, but exhibits a reversed or mirror-image routing. More specifically, second lace 70 extends consecutively (i.e., in order) through lace-receiving element 51, lace-receiving element 52, lace-receiving element 44, lace-receiving element 55, lace-receiving element 53, and again through lace-receiving element 51. Given this routing, second lace 70 passes twice through lace-receiving element 51, but only passes once through each of lace-receiving elements 43, 44, 52, and 55. That is, two segments (i.e., separate sections or portions) of second lace 70 extend through lace-receiving element 51. Another feature of this routing is that second lace 70 extends through (a) two consecutive lace-receiving elements 51 and 52 of medial series 50 and (b) two consecutive lace-receiving elements 43 and 44 of lateral series 40. Furthermore, a feature of this routing is that second lace 70 extends through three lace-receiving elements 51, 52, and 55 of medial series 50 and two lace-receiving elements 43 and 44 of lateral series 40.

Although lateral series 40 and medial series 50 are discussed above and depicted as extending longitudinally through portions of throat area 36 that respectively correspond with lateral side 14 and medial side 15, lateral series 40 and medial series 50 may not be restricted to this configuration. As an example, lateral series 40 and medial series 50 may curve toward lateral side 14 or may be positioned on lateral side 14. In general, however, lateral series 40 will be positioned more toward lateral side 14 than medial series 50, and medial series 50 will be positioned more toward medial side 15 than lateral series 40.

Figure 6:
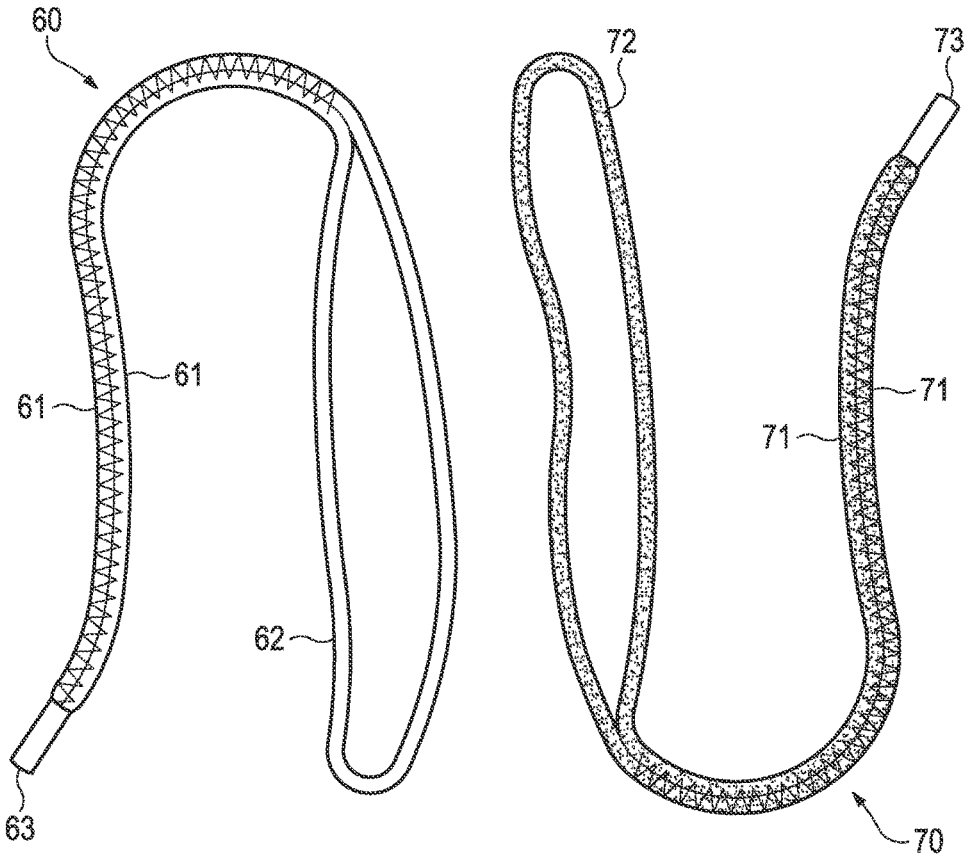
FIG. 6 is a top plan view of a pair of laces from the article of footwear.

When separated from a remainder of footwear 10, laces 60 and 70 exhibit the configuration depicted in FIG. 6. First lace 60 is generally formed from a single element of cord, for example, that is folded back upon itself and joined. More particularly, first lace 60 has two end lengths 61 and a central length 62. End lengths 61 are parallel and joined to each other. Although depicted as being joined with stitching, end lengths 61 may also be joined with an adhesive, thermal bonding, staples, or braiding, for example. That is, a variety of mechanical or chemical methods may be utilized to join end lengths 61. Central length 62 forms a loop. First lace 60 also includes a terminal end 63 at the terminus or extremities of end lengths 61 that is opposite central length 62. Second lace 70 has a similar configuration that includes two end lengths 71, a central length 72, and a terminal end 73. When incorporated into footwear 10, end lengths 61 and 71 may be tied together (or otherwise secured) or untied, as respectively depicted in FIGS. 2 and 3, to modify the dimensions of upper 30, whereas central lengths 62 and 72 generally pass through the various lace-receiving elements 41-45 and 51-55 in the routing discussed above. Based upon the discussion above, central length 62 passes through a set that includes lace-receiving elements 41, 42, 45, 53, and 54 and central length 72 passes through a set that includes lace-receiving elements 43, 44, 51, 52, and 55.

In some conventional articles of footwear, tensioning a lace involves simultaneously pulling on (a) multiple segments of the lace where the lace crosses between various lace-receiving elements and (b) end portions of the lace. In addition to utilizing both hands of the wearer, tensioning a lace in some conventional articles of footwear may be time-consuming and relatively difficult for the wearer. An advantage of the lacing system discussed above, however, is the relative quickness and ease with which upper 30 may be tightened around the foot. More particularly, the wearer need only pull on or otherwise place end lengths 61 and 71 in tension to tighten upper 30 around the foot because central lengths 62 and 72 freely slide through lace-receiving elements 41-45 and 51-55 when end lengths 61 and 71 are tensioned. As such, the wearer need not pull on segments of laces 60 and 70 that extend between or pass through lace-receiving elements 41-45 and 51-55 (i.e., central lengths 62 and 72) when securing the foot within footwear 10. Moreover, various individuals (e.g., children, elderly, disabled) may benefit greatly from the relative quickness and ease with which upper 30 may be tightened around the foot with the lacing system.

Further Configurations

Figure 7A:
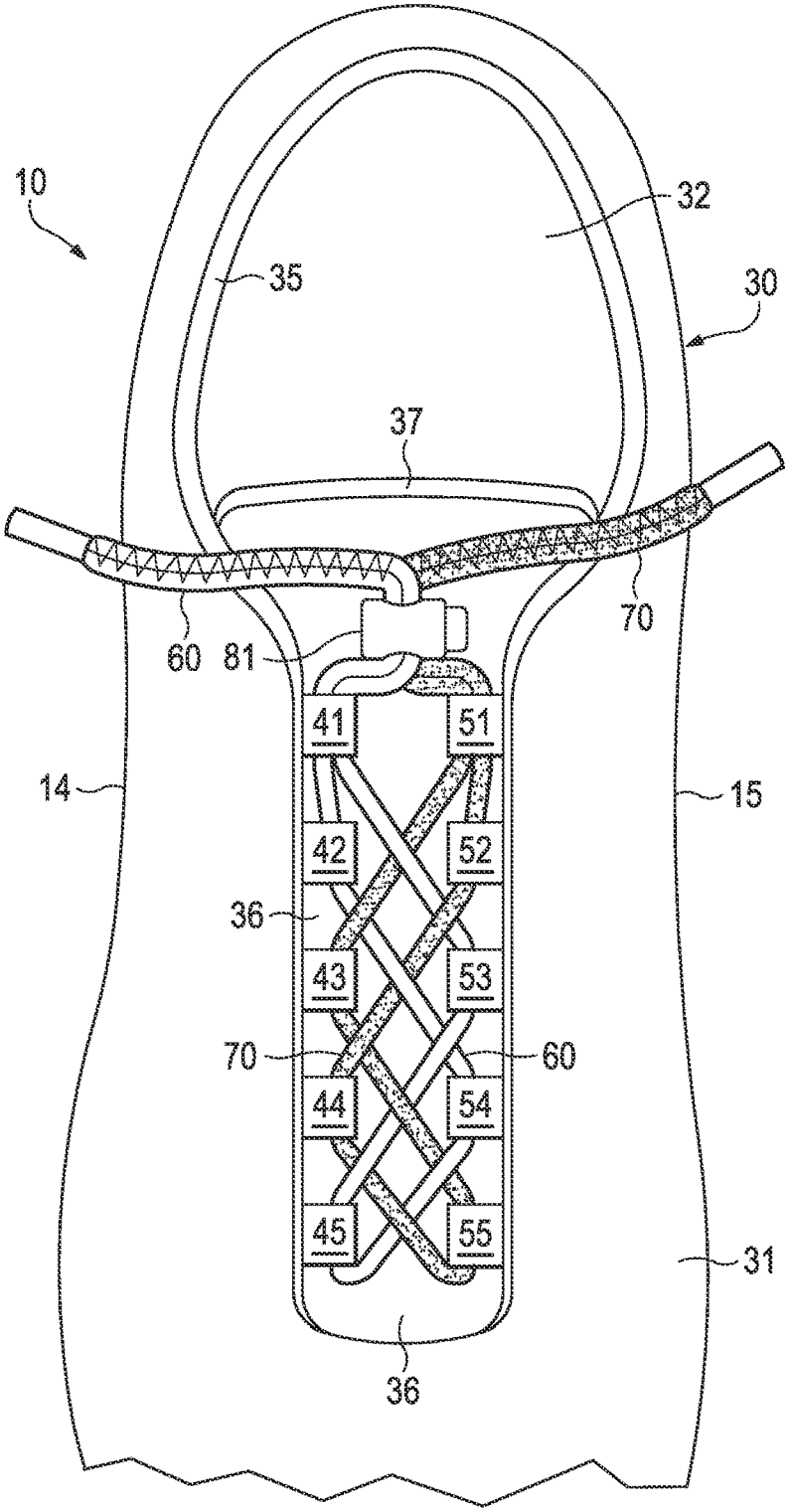
FIGS. 7A-7E are top plan views depicting further configurations of the article of footwear.
Figure 7B:
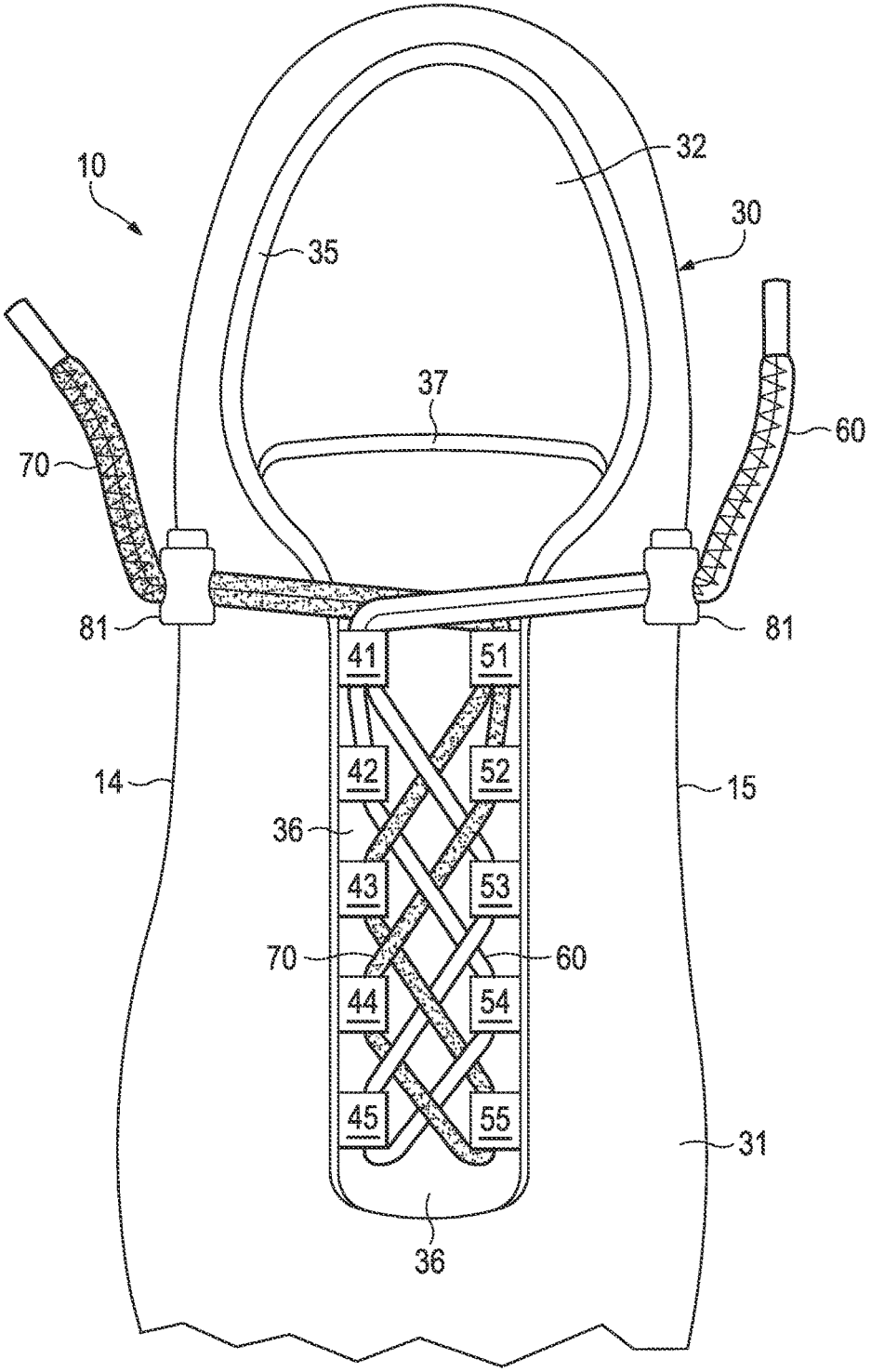

The general configuration discussed above provides an example of various features associated with the lacing system. Many of these features, however, may be modified or otherwise changed, while retaining the advantage of tightening upper 30 around the foot with relative ease. As an example, FIG. 7A depicts the lacing system of footwear 10 as including an adjustable locking device 81, which may have the configuration of a cord lock or other mechanical fastener. Rather than tying laces 60 and 70 together, locking device 81 may be utilized to retain tension in laces 60 and 70 when upper 30 is tightened around the foot. A similar configuration is depicted in FIG. 7B wherein two locking devices 81 are secured to covering element 31 adjacent to ankle opening 35. First lace 60 extends through one locking device 81 and second lace 70 extends through the other locking device 81. In this configuration, each of laces 60 and 70 may be independently tensioned. FIGS. 8-14 show an embodiment in which a connector 118 connects two sets of laces.

Figure 7C:
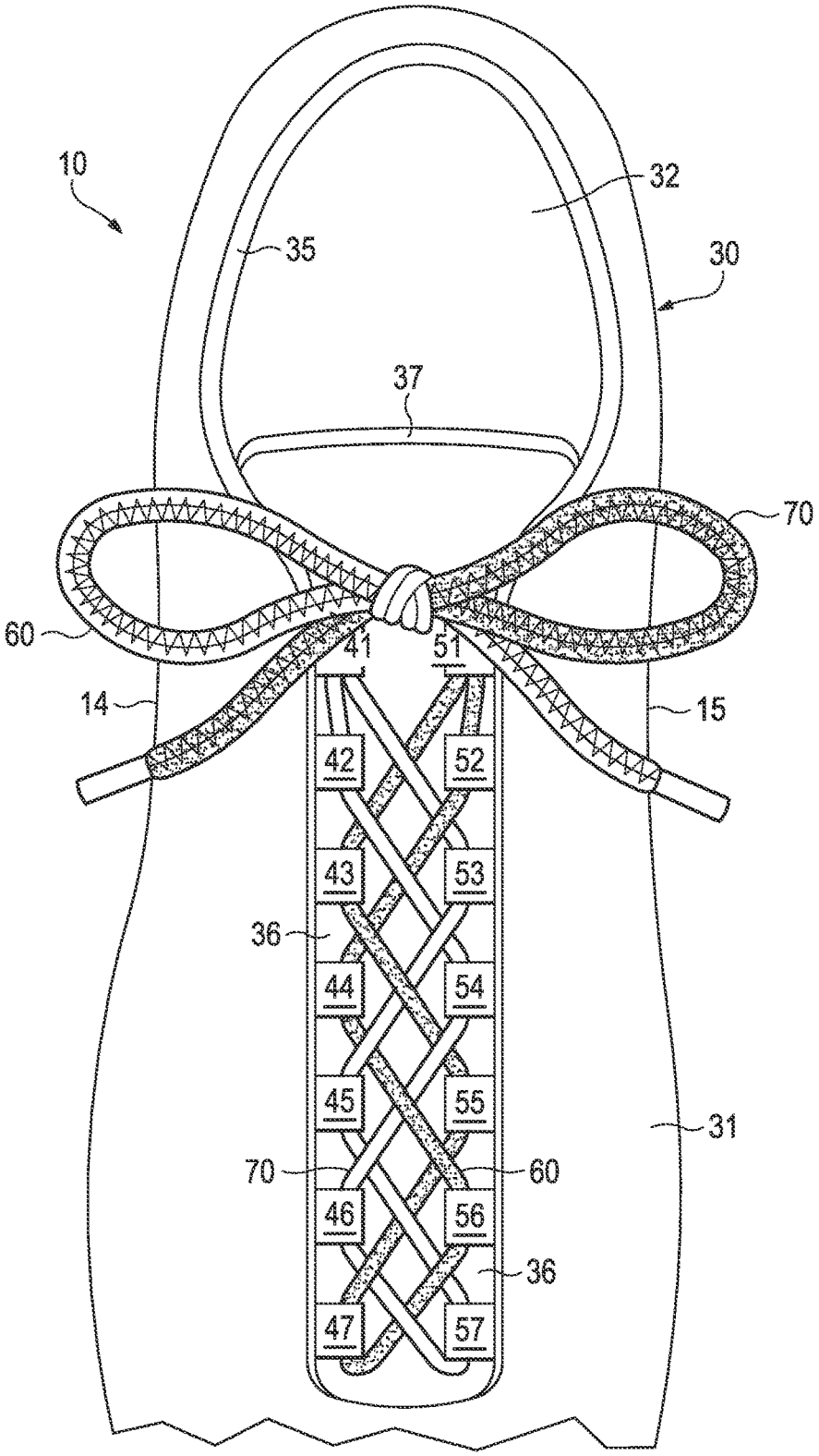

The lacing system discussed above includes five lace-retaining elements 41-45 and five lace retaining elements 51-55. Referring to FIG. 7C, however, footwear 10 is depicted as having a configuration incorporating seven lace-retaining elements 41-47 and seven lace retaining elements 51-57. In this configuration, first lace 60 extends past lace-retaining element 45 and passes through lace-retaining elements 46 and 57, and second lace 70 extends past lace-retaining element 55 and passes through lace-retaining elements 47 and 56. Larger articles of footwear, basketball shoes, and boots, for example, may utilize lacing systems with the additional lace-retaining elements 46, 47, 56, and 57. Moreover, more than seven pairs of lace-receiving elements may be incorporated into further articles of footwear.

Figure 7D:
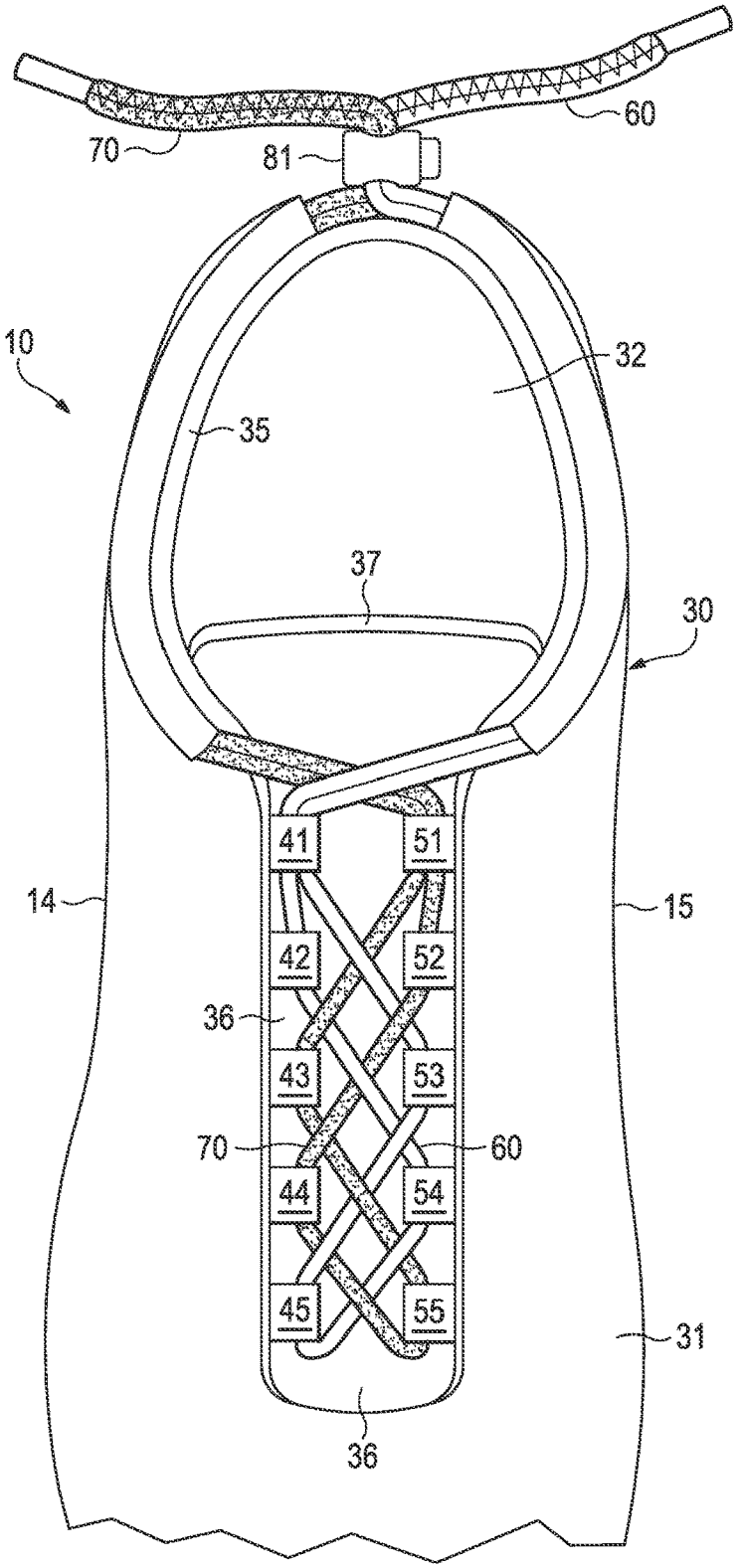

Another configuration of footwear 10 is depicted in FIG. 7D, wherein laces 60 and 70 extend into upper 30 and around ankle opening 35. Laces 60 and 70 exit upper 30 in a rear area of heel region 13, where locking device 81 is located. An advantage to this configuration is that laces 60 and 70 may further tighten ankle opening 35 around upper areas of the foot or the ankle of the wearer.

Figure 7E:
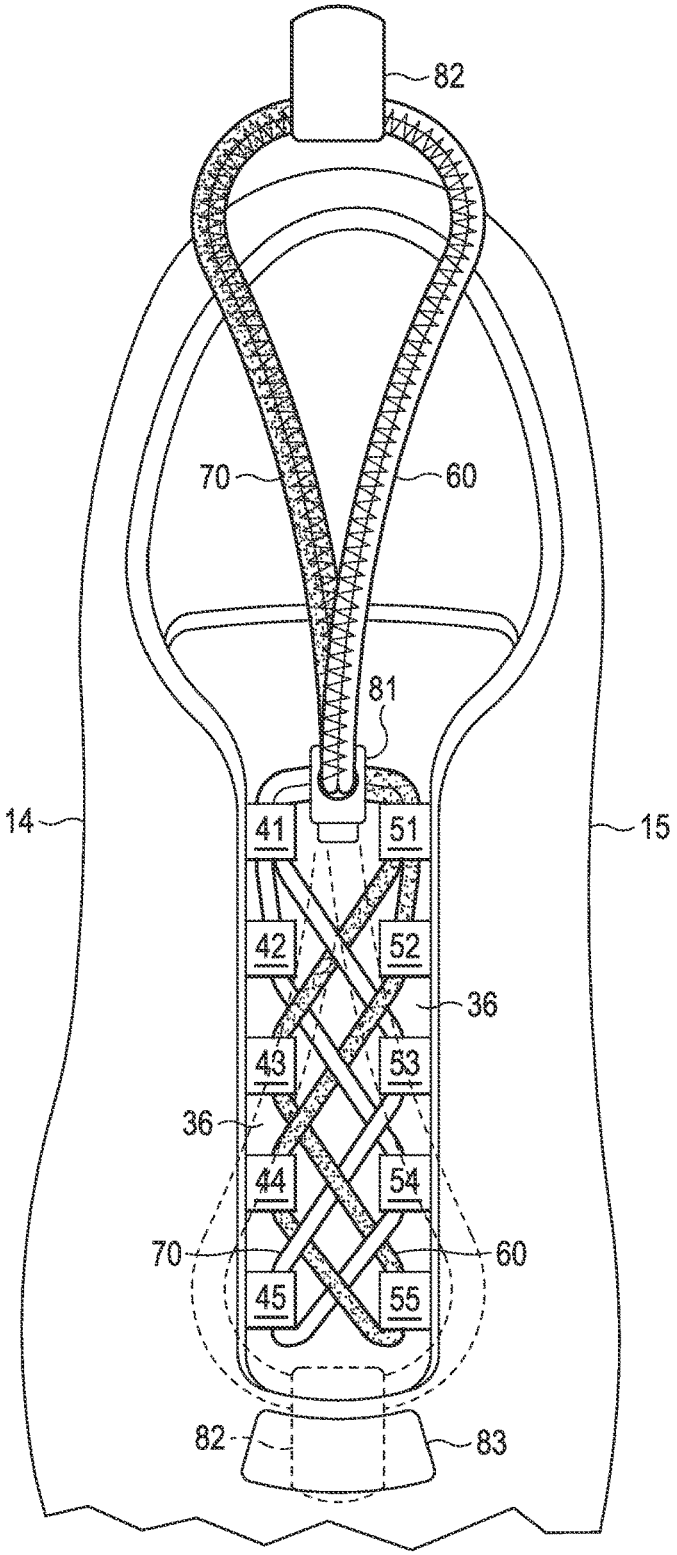

Yet another configuration of footwear 10 is depicted in FIG. 7E. In addition to locking device 81, the lacing system includes a retainer 82 and a securing member 83. Retainer 82 may be, for example, one part of a hook-and-loop fastener that extends around terminal ends 63 and 73. Similarly, securing member 83 may be another part of the hook-and-loop fastener that is secured to covering element 31. Although depicted as being located forward of throat area 36, securing member 83 may be located in various positions on upper 30. In this configuration, locking device 81 may be utilized to retain tension in laces 60 and 70. In order to prevent end lengths 61 and 71 from swinging, flopping, or otherwise moving when footwear 10 is worn, retainer 82 may engage securing member 83 to join the two parts of the hook-and-loop fastener together. Although the hook-and-loop fastener is suitable for retainer 82 and securing member 83, magnetic fasteners, buttons, snaps, and other types of fasteners may also be utilized.

The two parts of the hook-and-loop fastener generally include hooks in a hook part or loops in a loop part, with the hooks engaging the loops to secure the hook part and the loop part together. Although retainer 82 and securing member 83 may include either the hook part or the loop part, footwear 10 gains an advantage when (a) retainer 82 incorporates the loop part and (b) securing member 83 includes the hook part. More particularly, prior to engaging retainer 82 and securing member 83, end lengths 61 and 71 may contact other objects, such as apparel of the wearer or carpeting. If retainer 82 includes the hook part, retainer 82 may become inadvertently joined to one of the other objects. As such, incorporating the loop part into retainer 82 has the advantage of being less likely to engage the other objects.

Figure 17:
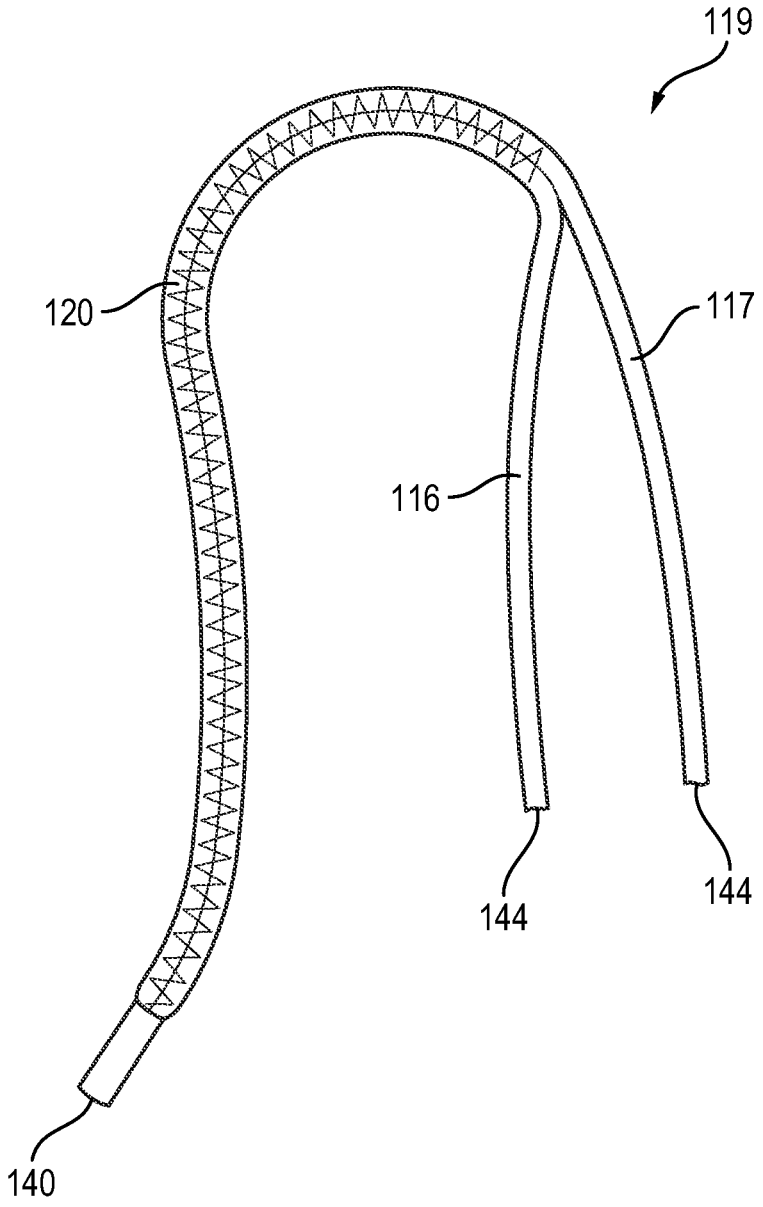
FIG. 17 shows an embodiment of a Y-shaped lace.
Figure 18:
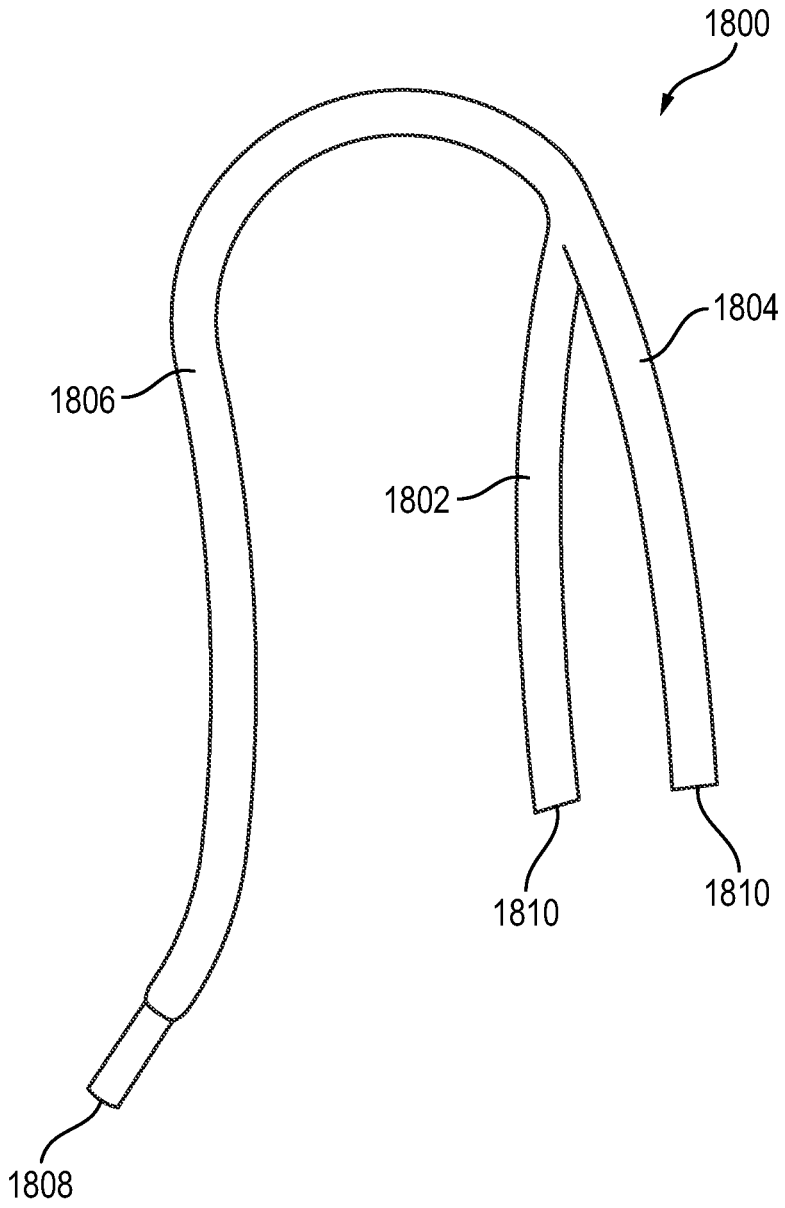
FIG. 18 shows an embodiment of a Y-shaped lace.

FIGS. 17 and 18 show examples of embodiments of Y-shaped laces. FIGS. 8-13 show an example of a lacing configuration in which Y-shaped laces may be used. In some embodiments, a connector may be used to connect the terminal ends of two sets of laces. For example, as shown in FIGS. 8-13, a connector 118 may connect two sets of Y-shaped laces such that the laces may be strung through lace-receiving elements. Such use of a connector may enable Y-shaped laces to be strung through lace-receiving elements starting near the ankle opening of the upper and proceeding toward the toe area. For example, connector 118 may connect two sets of laces such that the laces may be strung through lace-receiving elements starting near the ankle opening of the upper and proceeding toward the toe area, either by a manufacturer (for example) prior to providing the shoes to a user, or by the user after purchasing the laces. While lace 119 is shown as having a round cross-section and lace 1800 is shown as having a rectangular cross-section, it is understood that the laces may have any desired shape. For example, the laces may have a triangular, square, or oval cross-section.

Figure 16:
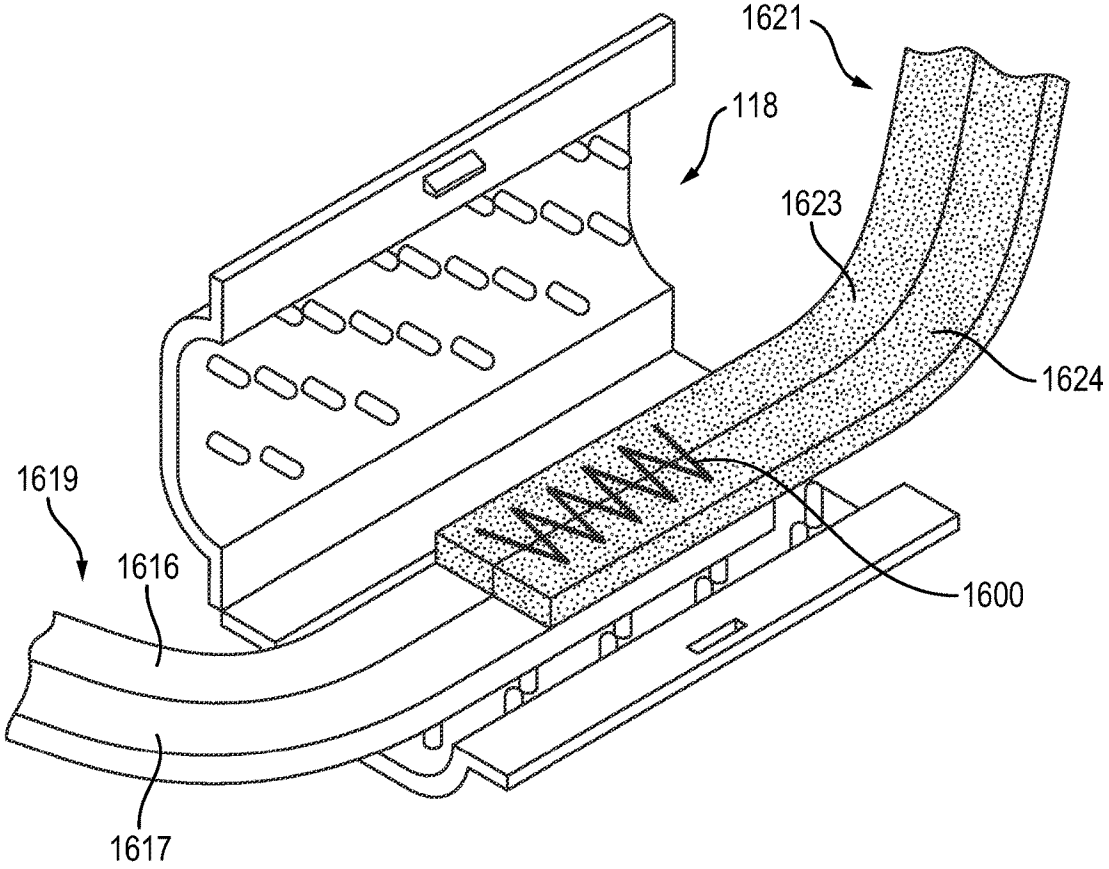
FIG. 16 shows an embodiment of a lacing system.

In some embodiments, the connector may be detachable such that the connector may be detached and reattached without damaging either the connector or a lace. For example, connector 118 may be detachable. A detachable connector may be helpful when a user wants to change the look of the article of footwear by using different colored laces. Additionally, such an embodiment may also be helpful when a user wants to replace a broken lace. As discussed in further detail below, connector 118 is shown in FIGS. 8-13 as having a clamshell configuration. However, it is understood that the connector may alternatively include or be configured as other types of mechanical connectors. For example, alternative connectors can be configured for user-operability to connect and disconnect lace ends, such as when replacing laces. Alternatively, connectors can be configured for one-time use, such that separating already-connected laces may involve damaging either the connector or a lace. A 'one-time use connector,' or "permanent connector," can be configured as a crimped metal band, a fused band (e.g., thermoplastic polyurethane, etc.), an adhesive, stitches, wraps, or another such connector or connection means generally understood to form and maintain a substantially permanent connection. For example, as shown in FIG. 16, stitching may be used to connect a first lace 1619 to a second lace 1621. In some embodiments, for example, as shown in FIG. 16, a permanent connector (e.g., stitching) may be used in conjunction with a detachable connector (e.g., connector 118). A detachable connector may be used in conjunction with a permanent connector for a variety of reasons. For example, a detachable connector may protect a permanent connector from damage and/or may serve as a backup to the permanent connector. In another example, a detachable connector may be added for aesthetic reasons. While a permanent connector is shown in conjunction with a detachable connector in FIG. 16, it is understood that a permanent connector may be used without a detachable connector.

Figure 8:
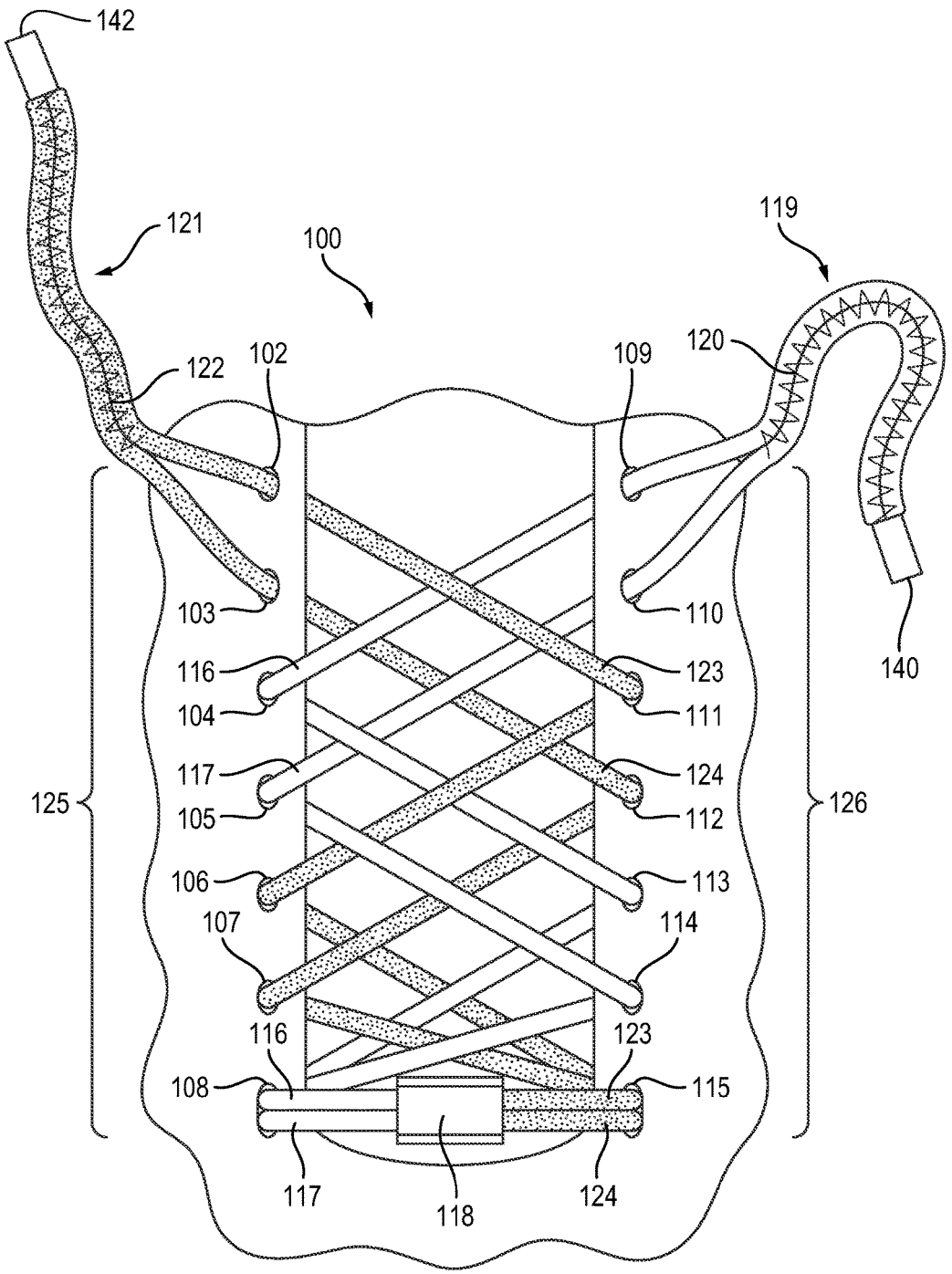
FIG. 8 shows an embodiment of an article of footwear having a lacing configuration.

While FIG. 8 focuses on the lacing configuration by only showing a portion of upper 100, it is understood that upper 100 may have the same features of the upper described in other embodiments. For example, upper 100 may have a void configured to or designed to receive a foot of a wearer. Upper 100 may have a lacing system that may include a lateral series 125 of lace-receiving elements, a medial series 126 of lace-receiving elements, a first lace 119, and a second lace 121. First lace 119 is shown separate from upper 100 in FIG. 17. It is understood that second lace 121 may be identical to first lace 119. An alternative embodiment of a lace 1800 may replace one or both of first lace 119 and second lace 121. First lace 119, second lace, 121, and lace 1800 are described in more detail below.

Lateral series 125 of lace-receiving elements include a first lace-receiving element 102, a second lace-receiving element 103, a third lace-receiving element 104, a fourth lace-receiving element 105, a fifth lace-receiving element 106, a sixth lace-receiving element 107, and a seventh lace-receiving element 108. First lace-receiving element 102 may be the topmost lace-receiving element of lateral series 125 and may be located adjacent to an ankle opening of the upper and may be located adjacent to an ankle opening of the upper. Seventh lace-receiving element may be the bottommost lace-receiving element of lateral series 125.

Medial series 126 of lace-receiving elements may include a first lace-receiving element 109, a second lace-receiving element 110, a third lace-receiving element 111, a fourth lace-receiving element 112, a fifth lace-receiving element 113, a sixth lace-receiving element 114, and a seventh lace-receiving element 115. First lace-receiving element 102 may be the topmost lace-receiving element of medial series 126 and may be located adjacent to an ankle opening of the upper. Seventh lace-receiving element 115 may be the bottommost lace-receiving element of medial series 126.

The laces used in the lacing configuration shown in FIG. 8 may include Y-shaped laces, such as, for example, first lace 119 and second lace 121 or lace 1800. The Y-shaped laces may have a first terminal end and a second terminal end opposite the first terminal end. For example, first lace 119 may include a first terminal end 140 and a second terminal end 144 opposite first terminal end 140. In another example, lace 1800 may have a first terminal end 1808 and a second terminal end 1810 opposite the first terminal end 1808. The Y-shaped laces may include a first lace element and a second lace element. For example, first lace 119 may include a first lace element 116 and a second lace element 117. In another example, lace 1800 may include a first lace element 1802 and a second lace element 1802. The first lace element and the second lace element may be coextensive. For example, first lace element 116 and second lace element 117 may be coextensive. The first lace element and the second lace element may converge to form a unitary lace segment defining an end length of the lace. For example, as described in more detail below, first lace element 116 and second lace element 117 may converge to form a unitary lace segment defining a first end length 120 of lace 119. In another example, as described in more detail below, first lace element 1802 and second lace element 1804 may converge to form a unitary lace segment defining a first end length 1806 of lace 1800. While lace 119 is shown as having a round cross-section and lace 1800 is shown as having a rectangular cross-section, it is understood that the laces may have any desired shape. For example, the laces may have a triangular, square, or oval cross-section.

In some embodiments, the first lace segment and the second lace segment may converge at a point where the first lace segment and the second lace segment are joined to form a unitary lace segment defining an end length of the lace. For example, first lace element 116 and second lace element 117 may be parallel and joined along a first end length 120 of first lace 119 disposed adjacent to first terminal end 140 of first lace 119. Although depicted as being joined with stitching, the first lace element and the second lace element of first lace 119 may also be joined with an adhesive, thermal bonding, staples, or braiding, for example. That is, a variety of mechanical or chemical methods may be utilized to join the lace elements. Alternatively, in some embodiments, instead of joining the first lace element and the second lace element to form an end length of the lace, the end length of the lace can be formed as a single strand during manufacturing (e.g., braided, or woven, etc.), which then bifurcates into two diverging strands comprising the first lace element and the second lace element. For example, as shown in FIG. 18, lace 1800 may include a first end length 1806 that may be formed as a single strand, or lace element, that bifurcates into first lace element 1802 and second lace element 1804. In some embodiments, the single strand may have the same thickness as the first lace element and the second lace element. For example, first end length 1806 may have the same thickness as first lace element 1802 and the same thickness as second lace element 1804. Alternatively, the single strand may have a thickness that is different from thickness of the first lace element and/or the thickness of the second lace element.

The Y-shaped laces may include an aglet on the first terminal end. For example, as shown in FIG. 8, an aglet may be disposed adjacent first terminal end 140 of first lace 119. In another example, lace 1800 may include an aglet disposed adjacent first terminal end 1808. As discussed in more detail below, first lace element 116 and second lace element 117 may be joined to form a Y-shaped lace before first lace 119 is purchased by the user, or the lace may be initially and integrally formed as a Y-shaped lace during manufacturing. As a result of either joining or integral formation, the first lace element and second lace element converge to form a first end length.

Figure 11:
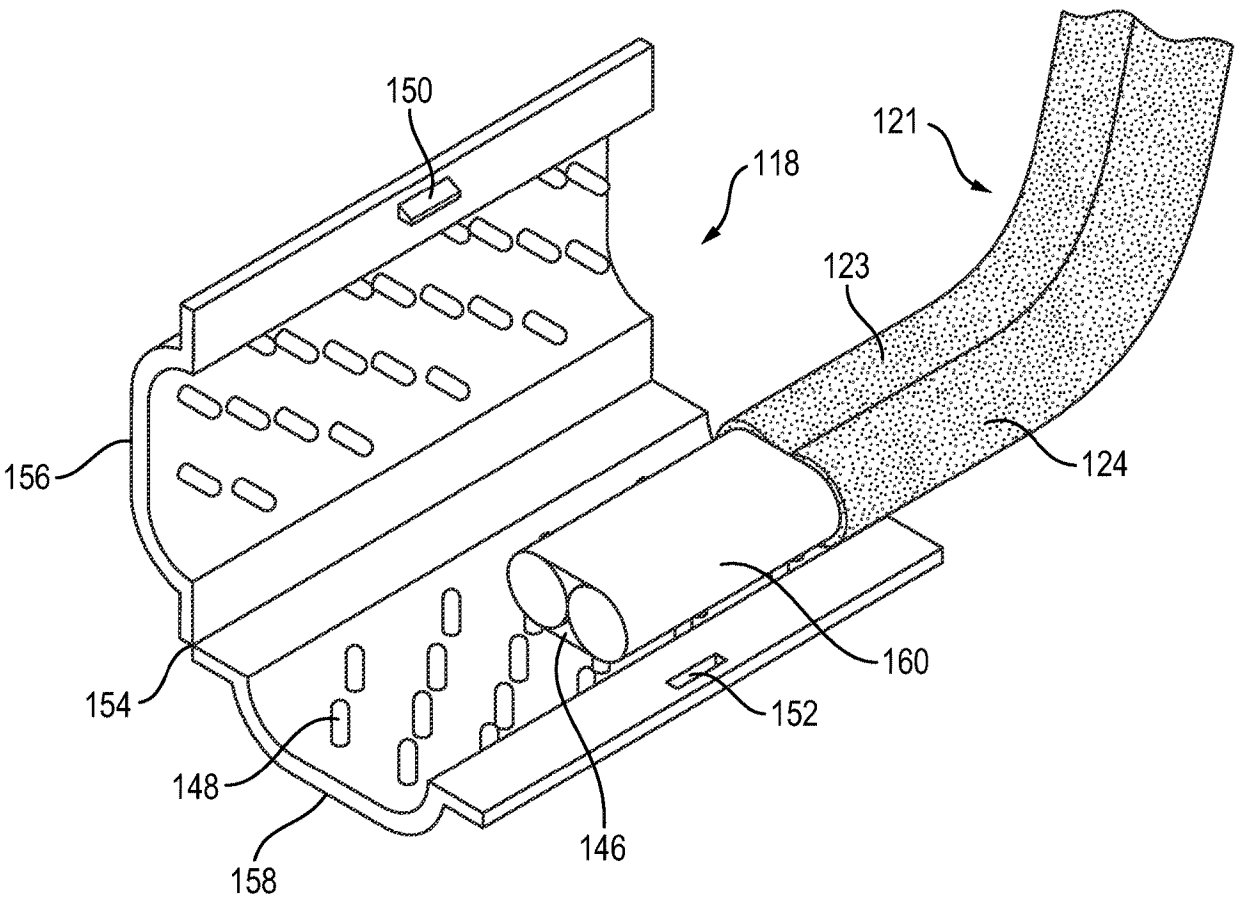
FIG. 11 is a view of the connector of FIG. 8 with a second end length of the second lace disposed on top of the second connector portion.
Figure 12:
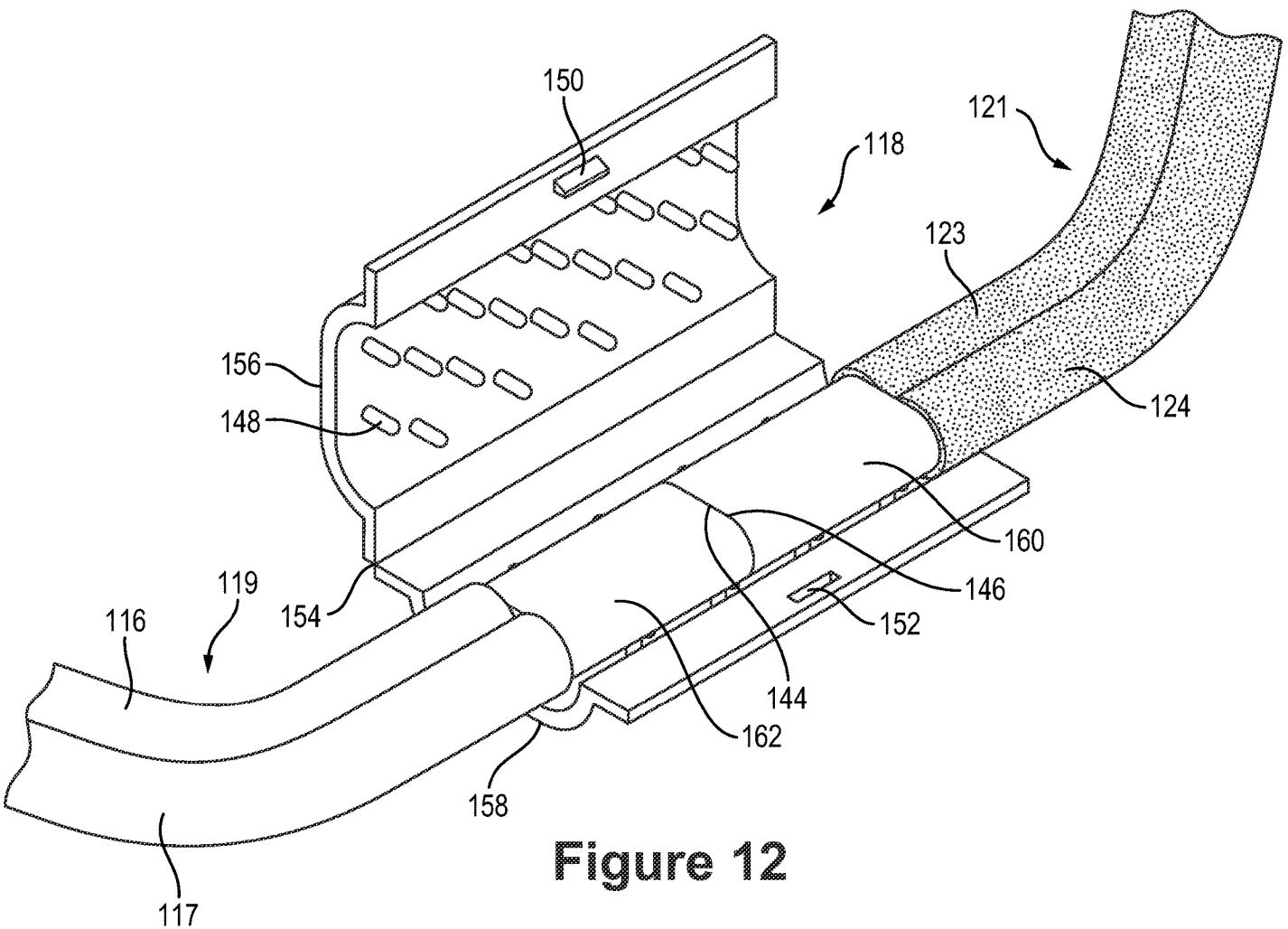
FIG. 12 is a view of the connector of FIG. 8 with a second end length of the first lace and a second end of the second lace both disposed on top of the second connector portion.

In some embodiments, first lace element 116 and second lace element 117 may be parallel and joined together along a second end length disposed adjacent to second terminal end 144. For example, as shown in FIGS. 11 and 12, first lace element 116 and second lace element 117 may be joined together by an aglet 162. As discussed in more detail below, the user may attach aglet 162 to first lace 119.

In some embodiments, to allow a user to replace first lace 119, aglet 162 may be included separately with a new lace. In such embodiments, a user may attach aglet 162 around the second end length of first lace 119. For example, aglet 119 may include a strip of material that may be wrapped around the second end length of first lace 119 and secured to itself by adhesive or any other mechanical or chemical methods. In some embodiments, other mechanical or chemical methods may be used to join first lace element 116 to second lace element 117 along the second end length. For example, FIG. 16 shows an embodiment in which stitching 1600 may be used to join a first lace segment 1616 to a second lace segment 1617 and a first lace segment 1623 to a second lace segment 1624. As shown in FIG. 16, a permanent connector (e.g., stitching) may be used in conjunction with a detachable connector (e.g., connector 118). A detachable connector may be used in conjunction with a permanent connector for a variety of reasons. For example, a detachable connector may protect a permanent connector from damage and/or may serve as a backup to the permanent connector. In another example, a detachable connector may be added for aesthetic reasons. While a permanent connector is shown in conjunction with a detachable connector in FIG. 16, it is understood that a permanent connector may be used without a detachable connector. Similarly, while two different types of detachable connectors are shown in FIG. 12, it is understood that aglet 162 may be absent and first lace element 116 and second lace element 117 may be unattached along the second end length before purchase. In other words, first lace 119 may be Y-shaped before being laced through the eyelets of a shoe. In such embodiments, the user may use connector 118 to attach first lace element 116 to second lace element 117 along the second end length of first lace 119 and the two lace elements of first lace 119 may be connected by only connector 118.

Second lace 121 may include a first terminal end 142 and a second terminal end 146 opposite first terminal end 142. Second lace 121 may include a first lace element 123 and a second lace element 124. First lace element 123 and second lace element 124 may be parallel and coextensive. First lace element 123 and second lace element 124 may be parallel and joined along a first end length 122 of second lace 121 disposed adjacent to first terminal end 142 of second lace 121. Although depicted as being joined with stitching, the first lace element and the second lace element of second lace 121 may also be joined with an adhesive, thermal bonding, staples, or braiding, for example. That is, a variety of mechanical or chemical methods may be utilized to join the lace elements. As shown in FIG. 8, an aglet may be disposed adjacent first terminal end 142 of second lace 121. As discussed in more detail below, first lace element 123 and second lace element 124 may be joined to form a Y-shaped lace before second lace 121 is laced through the eyelets of a shoe.

In some embodiments, first lace element 123 and second lace element 124 may be parallel and joined together along a second end length disposed adjacent to second terminal end 146. For example, as shown in FIGS. 11 and 12, first lace element 123 and second lace element 124 may be joined together by an aglet 160. As discussed above with respect to first lace 119 and aglet 162, the user may attach aglet 160 to second lace 121. Additionally, as discussed above with respect to first lace 119, in some embodiments, aglet 102 may be absent and first lace element 123 and second lace element 124 may be unattached along the second end length before purchase. In other words, second lace 121 may be Y-shaped before purchase.

In some embodiments, an article of footwear may be sold with the type of laces shown in FIG. 8 already laced through the lace-receiving elements. In some embodiments, an article of footwear may be sold with the type of laces shown in FIGS. 17 and 18, but the laces may not be laced through the lace-receiving elements at the time of purchase. In some embodiments, replacement laces may be sold separately from an article of footwear. In embodiments where Y-shaped laces are not yet laced through the lace-receiving elements at the time of purchase, the user may lace the unattached portions of the first lace elements and the second lace elements of the laces through the series of lace-receiving elements. The path of this lacing may begin with the topmost lace-receiving elements and then may follow the path shown in FIG. 8. Then, aglets and/or a connector may be used to connect the second terminal ends of the laces together between the bottommost lace-receiving elements of the lateral series and the medial series, as discussed in more detail below.

When incorporated into an article of footwear, the first end lengths of first lace 119 and second lace 121 may be tied together (or otherwise secured) or untied to modify the dimensions of upper 100. The end lengths of first lace 119 and second lace 121 may be configured to or designed to be tied together. For example, the end lengths of both laces may have a length sufficient for tying the two end lengths together to form a bow knot. FIG. 1 shows an example of a bow knot of the type that the end lengths of both laces may be tied into. Additionally, the remaining length of the laces that is disposed between the first end length and the second terminal end may be a length sufficient to allow the laces to be loosened when incorporated into an article of footwear.

First lace element 116 and second lace element 117 of first lace 119 may together extend through seventh lace-receiving element 108. First lace element 116 may extend from seventh lace-receiving element 108 to and through fifth lace-receiving element 113. First lace element 116 may extend from fifth lace-receiving element 113 to and through third lace-receiving element 104. First lace element 116 may extend from third lace-receiving element 104 to and through first lace-receiving element 109.

Second lace element 117 may extend from seventh lace-receiving element 108 to and through sixth lace-receiving element 114. Second lace element 117 may extend from sixth lace-receiving element 114 to and through fourth lace-receiving element 105. Second lace element 117 may extend from fourth lace-receiving element 105 to and through second lace-receiving element 110.

First lace element 123 and second lace element 124 of second lace 121 may together extend through seventh lace-receiving element 115. First lace element 123 may extend from seventh lace-receiving element 115 to and through fifth lace-receiving element 106. First lace element 123 may extend from fifth lace-receiving element 106 to and through third lace-receiving element 111. First lace receiving element 123 may extend from third lace-receiving element 111 to and through first lace-receiving element 102.

Second lace element 124 may extend from seventh lace-receiving element 115 to and through sixth lace-receiving element 107. Second lace element 124 may extend from sixth lace-receiving element 107 to and through fourth lace-receiving element 112. Second lace element 124 may extend from fourth lace-receiving element 112 to and through second lace-receiving element 103.

Figure 9:
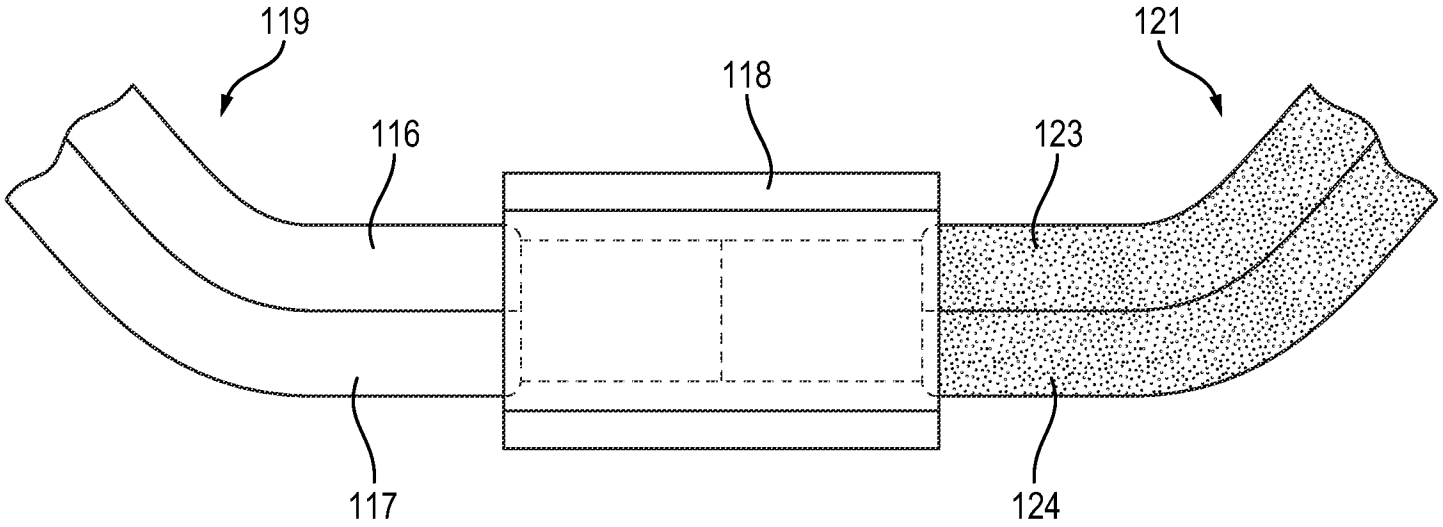
FIG. 9 is an isolated view of the connector of FIG. 8 holding together the first lace and second lace.

As previously discussed, FIGS. 8-9 show connector 118 connecting first lace 119 to second lace 120 at a point between seventh lace-receiving element 108 and seventh lace-receiving element 115. In some embodiments, connector 118 may connect first lace element 116 to second lace element 117. In some embodiments, connector 118 may connect first lace element 123 to second lace element 124.

Figure 10:
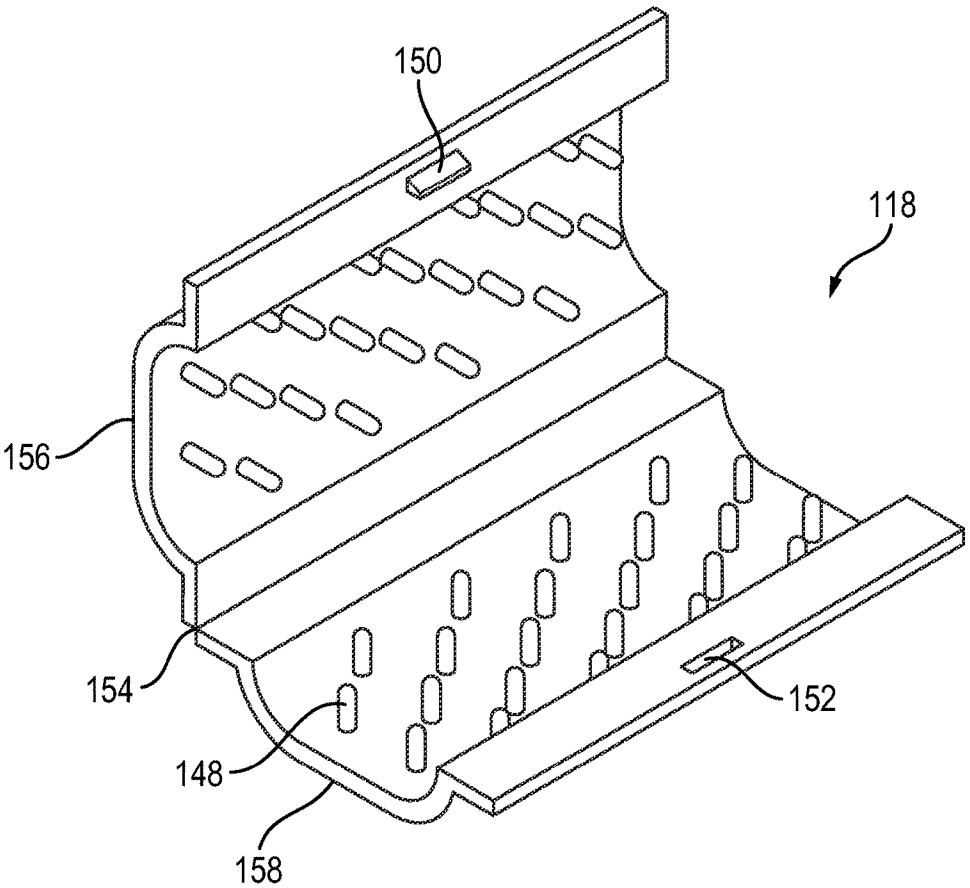
FIG. 10 is a view of the connector of FIG. 8 in an open position.

As previously stated, connector 118 may have a clamshell configuration. Connector 118 may include a first connector portion 156 and a second connector portion 158. A hinge 154 may connect first connector portion 156 to second connector portion 158 such that first connector portion 156 and second connector portion 158 may pivot with respect to one another. A first fastener element 150 may be disposed on first connector portion 156 and a second fastener element 152 may be disposed on second connector portion 158. First fastener element 150 may fit together with second fastener element 152 to lock first connector portion 156 and second connector portion 158 together around first lace 119 and second lace 121. Once the first fastener element 150 and second fastener element 152 are locked together, the fastener elements may be unlocked to open connector 118 such that first lace 119 and second lace 121 may be removed from connector 118. As shown in FIGS. 10-12, an interior surface of first connector portion 156 and second connector portion 158 may include a plurality of pins 148. Pins 148 may extend away from the interior surface of first connector portion 156 and second connector portion 158 such that pins 148 penetrate first lace 119 and second lace 121 to secure the laces within connector 118. In some embodiments, pins 148 may be sharp enough to penetrate the laces through aglet 160 and aglet 162.

Figure 13:
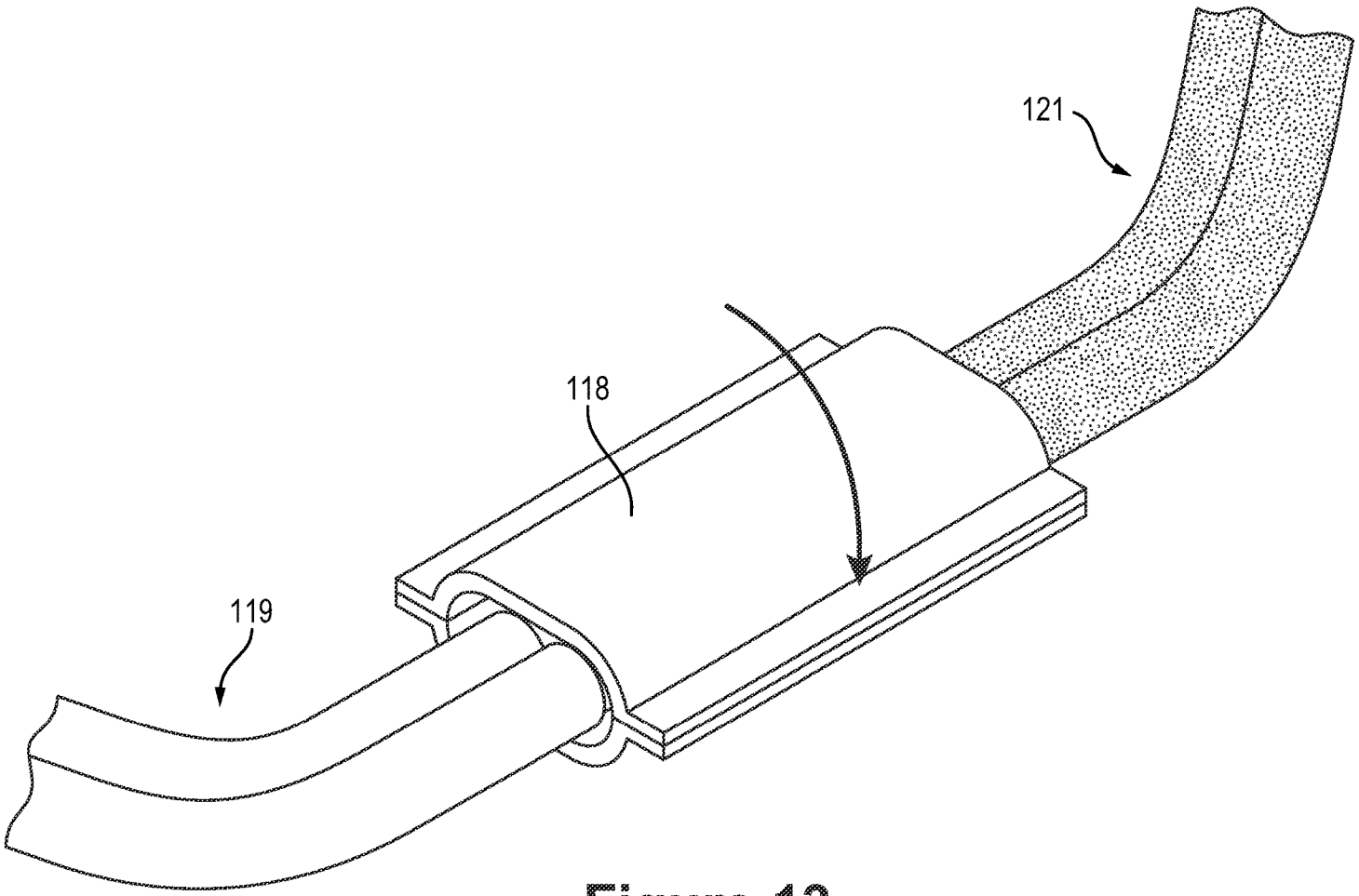
FIG. 13 shows the connector of FIG. 8 in a closed position about the second end length of the first lace and the second end of the second lace.

FIGS. 11-13 show connector 118 in various stages of connecting first lace 119 with second lace 121. As shown in FIG. 11, the second end length of second lace 121 may be placed between first connector portion 156 and second connector portion 158 before closing first connector portion 156 and second connector portion 158 together. While FIG. 11 shows the second end length of second lace 121 having an aglet, it is understood that the aglet may be absent. As shown in FIG. 12, the second end length of second lace 121 and the second end length of first lace 119 may both be placed between first connector portion 156 and second connector portion 158 before closing first connector portion 156 and second connector portion 158 together. While FIG. 11 shows the second end length of first lace 119 having an aglet, it is understood that the aglet may be absent. FIG. 13 shows connector 118 closed around the second end lengths of first lace 119 and second lace 120.

In some embodiments, the laces described with respect to FIGS. 8-13 may be made by the following method. In some embodiments, the method may include a step of providing a first lace element and a second lace element. In some embodiments, the method may include a step of providing a first lace element and a second lace element having the same length as the first lace element. In some embodiments, the method may include a step of providing a first lace element and a second lace element having different lengths from one another and cutting the lace elements to make the lace elements have the same length. The method may include a step of aligning the first lace element side-by-side with the second lace element such that the first lace element is parallel with the second lace element and the terminal ends of the lace elements are aligned with one another.

In some embodiments, the method may include 3D printing (additive manufacturing) a lace having a Y-shape. In some embodiments, the method may include using additive printing to make a first lace element and a second lace element. In some embodiments, the method may include using additive printing to make an end length of a lace that is formed of a single lace element. In such embodiments, the end length of the lace may be added to the first lace element and the second lace element to connect the first lace element to the second lace element.

In some embodiments, the method may include joining a portion of the first lace element to a portion of the second lace element, collectively forming a Y-shaped lace. In some embodiments, the method may include joining a portion of the first lace element to a portion of the second lace element to form a unitary lace segment defining an end length of the lace. In some embodiments, the step of joining a portion of the first lace element to a portion of the second lace element may include stitching a portion of the first lace element to a portion of the second lace element. In some embodiments, the step of joining a portion of the first lace element to a portion of the second lace element may include thermally bonding a portion of the first lace element to a portion of the second lace element. In such embodiments, the step of thermally bonding the portions of the lace elements may include applying heat and pressure to the portions of the lace elements together such that the laces melt slightly from the heat and fuse together. In some embodiments, the method may include applying an aglet around the unitary lace segment defining the end length of the lace. In some embodiments, the step of joining the first lace element to a portion of the second lace element may include forming a single strand lace, or lace element, and bifurcating the lace into two diverging lace segments during manufacturing of the lace. For example, in such embodiments, a knitting process may be used to form a single strand lace, or lace element, that diverges into two lace segments. In another example, additive printing may be used to form a single strand lace, or lace element, that diverges into two lace segments.

Figure 14:
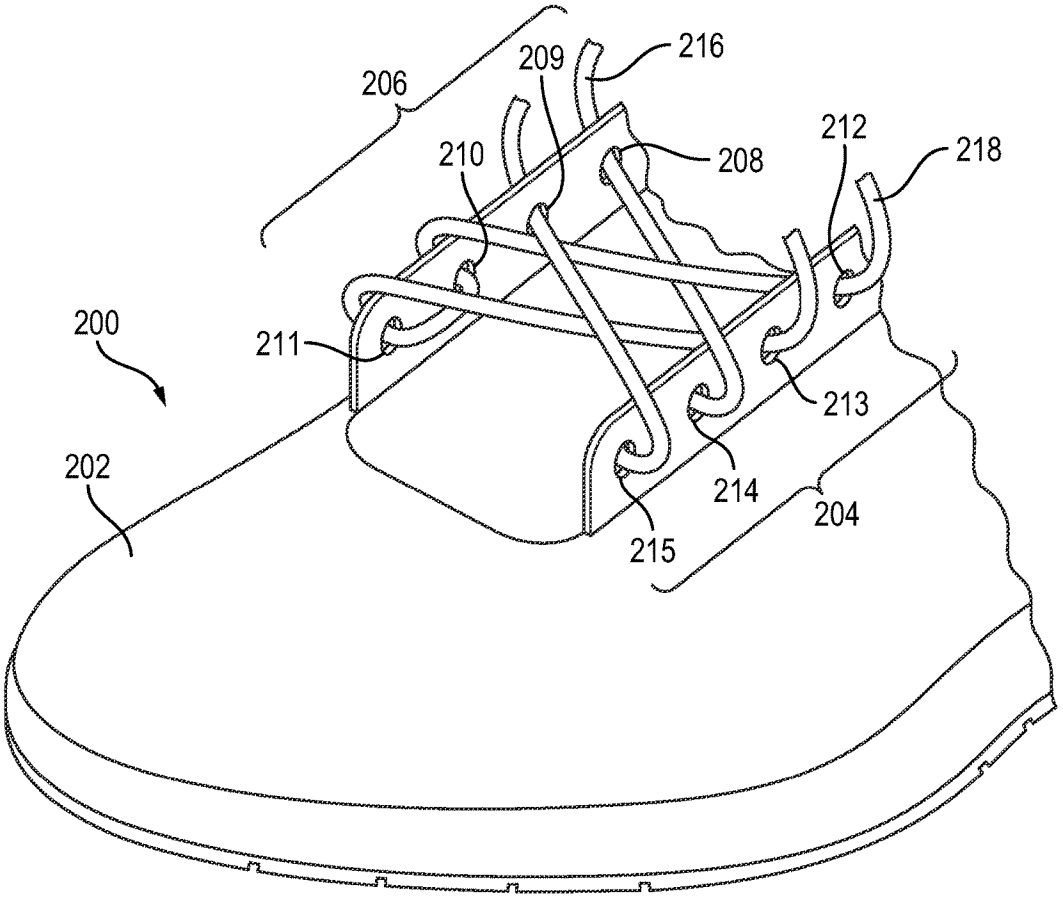
FIG. 14 shows an embodiment of an article of footwear having a lacing configuration.

FIG. 14 discloses another lacing configuration for laces similar to those shown in FIG. 6. FIG. 14 shows an article of footwear 200 having an upper 202. Upper 202 may have a lateral series of lace-receiving elements 204 and a medial series of lace receiving elements 206 that is spaced from and parallel to the first series. Lateral series 204 and medial series 206 are each shown in FIG. 14 as having 4 lace-receiving elements, but it is understood that lateral series 204 and medial series 206 may each have more than 4 lace-receiving elements. For example, lateral series 204 and medial series 206 may each have between 4 and 30 lace-receiving elements. An example of an embodiment in which lateral series 204 and medial series 206 each have 30 lace-receiving elements may be an embodiment in which the article of footwear is a boot. Lateral series 204 may include a first lace-receiving element 212, a second lace-receiving element 123, a third lace-receiving element 214, and a fourth lace-receiving element 215. First lace-receiving element 212 may be a topmost lace-receiving element and fourth lace-receiving element 215 may be a bottommost lace-receiving element. Medial series may include a first lace-receiving element 208, a second lace-receiving element 209, a third lace-receiving element 210, and a fourth lace-receiving element 210. First lace-receiving element 208 may be a topmost lace-receiving element and fourth lace-receiving element 211 may be a bottommost lace-receiving element.

FIG. 14 shows a first lace 216 and a second lace 218. First lace 216 may have the same features as lace 60 in FIG. 6 and second lace 218 may have the same features as lace 70 in FIG. 6. For example, first lace 216 and second lace 218 may each include end lengths and a central length. The portions of first lace 216 and second lace 218 shown in FIG. 14 may be the central length of the laces. As shown in FIG. 14, the central length of second lace 218 may extend through third lace-receiving element 210 to and through fourth lace-receiving element 211. In a similar manner, the central length of first lace 216 may extend through third lace-receiving element 214 to and through fourth lace-receiving element 215. The central length of first lace 216 may extend from fourth lace-receiving element 215 to and through second lace-receiving element 209. The central length of first lace 216 may extend from third lace-receiving element 214 to and through first lace-receiving element 208. The central length of second lace 218 may extend from third lace-receiving element 210 to and through first lace-receiving element 218. The central length of second lace 218 may extend from fourth lace-receiving element 211 to and through second lace-receiving element 213. In some embodiments, the remainder of first lace 216 extending beyond first lace-receiving element 208 and second lace-receiving element 209 may be joined together to form a unitary lace segment. In some of these embodiments, the unitary lace segment of the first lace may be tied to a unitary lace segment of the second lace to form a bow knot. For example, FIG. 1 shows a bow knot of the type that the unitary lace segment of the first lace and the unitary lace segment of the second lace may be tied into. In some of these embodiments, the lateral series may include a lace-receiving element above first lace-receiving element 212 and the unitary lace segment may extend through the lace-receiving element that is above first lace-receiving element 212. It is understood that any variations explained with respect to first lace 216 may be possible for second lace 218.

Figure 15:
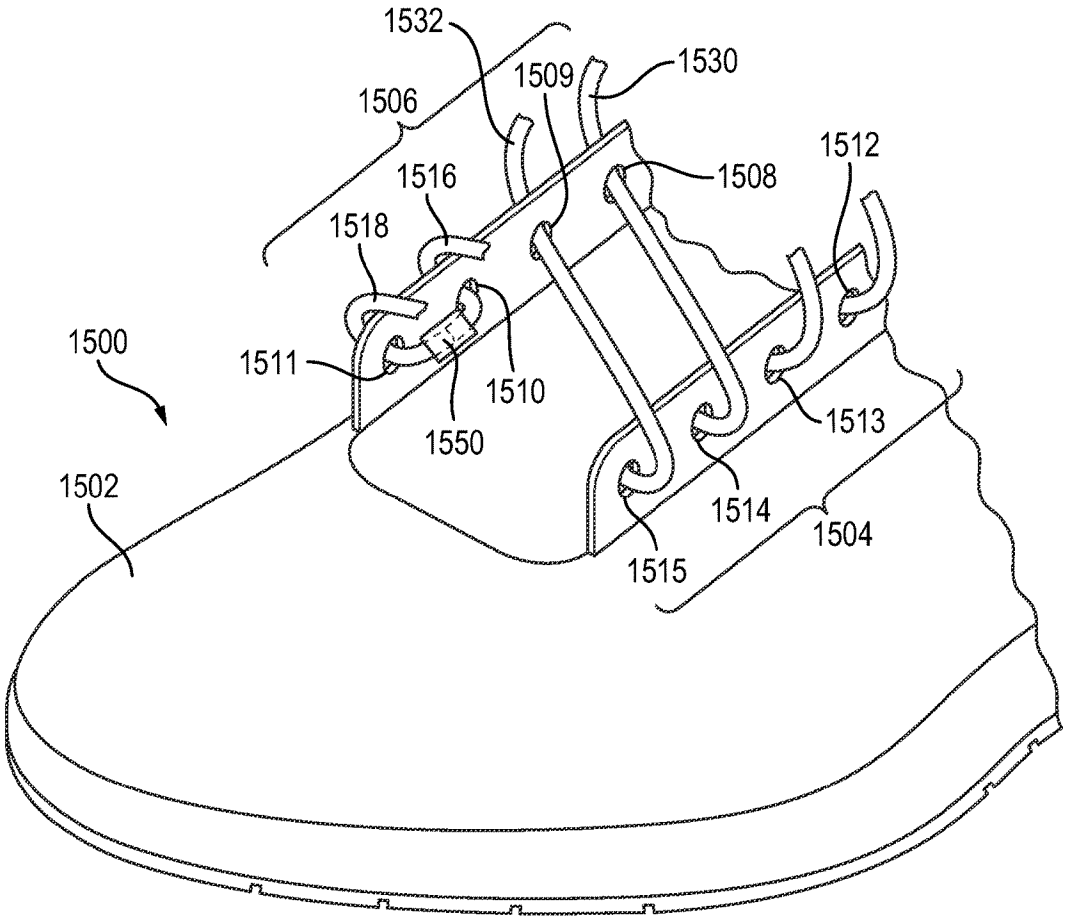
FIG. 15 shows an embodiment of an article of footwear having a lacing configuration.

FIG. 15 discloses another lacing configuration similar to that of FIG. 14. FIG. 15 shows an article of footwear 1500 having an upper 1502. Upper 1502 may have a lateral series of lace-receiving elements 1504 and a medial series of lace receiving elements 1506 that is spaced from and parallel to the first series. Lateral series 1504 and medial series 1506 are each shown in FIG. 15 as having 4 lace-receiving elements, but it is understood that lateral series 1504 and medial series 1506 may each have more than 4 lace-receiving elements. For example, lateral series 1504 and medial series 1506 may each have any number of lace-receiving elements selected from a range of between 4 and 30 lace-receiving elements. An example of an embodiment in which lateral series 1504 and medial series 1506 each have 30 lace-receiving elements may be an embodiment in which the article of footwear is a boot. Lateral series 1504 may include a first lace-receiving element 1512, a second lace-receiving element 1523, a third lace-receiving element 1514, and a fourth lace-receiving element 1515. First lace-receiving element 1512 may be a topmost lace-receiving element and fourth lace-receiving element 1515 may be a bottommost lace-receiving element. Medial series 1506 may include a first lace-receiving element 1508, a second lace-receiving element 1509, a third lace-receiving element 1510, and a fourth lace-receiving element 1511. First lace-receiving element 1508 may be a topmost lace-receiving element and fourth lace-receiving element 1511 may be a bottommost lace-receiving element.

FIG. 15 shows a first lace element 1516 and a second lace element 1518 of a lace that may have the same features as first lace 119 in FIG. 17. For example, first lace element 1516 and second lace element 1518 may extend from a unitary lace segment to form a Y-shaped lace. As shown in FIG. 15, the first and second lace elements may be connected by a connector 1550. A portion of first lace 1516 is removed from the view in FIG. 15 to give a better view of connector 1550. Connector 1550 may be a permanent connector or a detachable connector, as described above. For example, as shown in FIG. 15, connector 1550 may be a metal band crimped around terminal ends (shown in phantom lines) of first lace element 1516 and second lace element 1518 to connect the two together. FIG. 15 shows a first lace element 1530 and a second lace element 1532 of a lace that may have the same features as first lace 119 in FIG. 17. Similar to first lace element 1516 and second lace element 1518, first lace element 1530 and second lace element 1532 may be connected by a connector that is hidden from view in FIG. 15.

First lace element 1516 may extend through third lace-receiving element 1510 to and through first lace-receiving element 1512. Second lace element 1518 may extend through fourth lace-receiving element 1511 to and through second lace-receiving element 1513. First lace element 1516 and second lace element 1518 may be connected by connector 1550 between fourth lace-receiving element 1511 and third lace-receiving element 1510.

First lace element 1530 may extend through third lace-receiving element 1514 to and through first lace-receiving element 1508. Second lace element 1532 may extend through fourth lace-receiving element 1515 to and through second lace-receiving element 1513. First lace element 1530 and second lace element 1532 may be connected by a connector (hidden from view by portion of upper 1502 along which second series 1504 is located) between fourth lace-receiving element 1515 and third lace-receiving element 1514.

In some embodiments, the remainder of first lace element 1516 extending beyond first lace-receiving element 1512, and the remainder of second lace element 1518 extending beyond second lace-receiving element 1513, may be joined together to form a unitary lace segment. In some embodiments, the remainder of first lace element 1530 extending beyond first lace-receiving element 1508 and the remainder of second lace element 1532 extending beyond second lace-receiving element 1509 may be joined together to form a unitary lace segment. In some of these embodiments, the unitary lace segment of the first lace may be tied to a unitary lace segment of the second lace to form a bow knot. For example, FIG. 1 shows a bow knot of the type that the unitary lace segment of the first lace and the unitary lace segment of the second lace may be tied into. In some embodiments, the lateral series may include a lace-receiving element above first lace-receiving element 1512 and the unitary lace segment formed by first lace element 1530 and second lace element 1532 may extend through the lace-receiving element that is above first lace-receiving element 1512. Similarly, in such embodiments, the medial series may include a lace-receiving element above first lace receiving element 1508 and the unitary lace segment formed by first lace element 1516 and second lace element 1518 may extend through such a lace-receiving element.

While the lace-receiving elements shown in FIGS. 8, 14, and 15 are openings disposed in an upper, it is understood that the lace-receiving elements may include other types of lace-receiving elements. For example, the lace-receiving elements may include tubular structures, like those shown in FIG. 1. While seven lace-receiving elements are shown in the series of lace-receiving elements of FIG. 8 and four lace-receiving elements are shown in FIGS. 14 and 15, it is understood that another number of lace-receiving elements may be included. For example, in some embodiments, the lateral series and/or medial series of lace-receiving elements may each have any number of lace-receiving elements selected from a range of between 4 and 30 lace-receiving elements. An example of an embodiment in which the lateral series and the medial series each have 30 lace-receiving elements may be an embodiment in which the article of footwear is a boot.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of footwear having an upper and a sole structure, the upper including a lacing system comprising:

a first series of lace-receiving elements extending in a longitudinal direction of the footwear;

a second series of lace-receiving elements extending in the longitudinal direction of the footwear, the second series being spaced from and parallel to the first series;

a first lace that comprises a first lace element and a second lace element that is coextensive with the first lace element, the first lace having a first terminal end and a second terminal end opposite the first terminal end; and a second lace that comprises a first lace element and a second lace element that is coextensive with the first lace element, wherein the second lace has a first terminal end and a second terminal end opposite the first terminal end;

wherein the first lace element and the second lace element converge to form a unitary lace segment defining an end length of the first lace disposed adjacent to the first terminal end of the first lace, and the first lace element and the second lace element are joined to each other along the end length by a permanent connector interconnecting the first lace element and the second lace element along the end length, the first lace element is in direct contact with the second lace element along the end length, and the first lace element and the second lace element are parallel to each along the end length;

wherein the first lace element and second lace element of the second lace converge to form a unitary lace segment defining an end length of the second lace disposed adjacent to the first terminal end of the second lace;

wherein the first lace element of the first lace extends through a topmost lace-receiving element of the first series of lace-receiving elements located adjacent to an ankle opening of the upper and the second lace element of the first lace extends through a lace-receiving element of the first series of lace-receiving elements that is consecutive with the topmost lace-receiving element of the first series of lace-receiving elements;

wherein, at a point disposed adjacent to the second terminal end of the first lace, the first lace element and the second lace element of the first lace together extend through a bottommost lace-receiving element of the second series of lace-receiving elements;

wherein, at a point disposed adjacent to the second terminal end of the second lace, the first lace element and the second lace element of the second lace together extend through a bottommost lace-receiving element of the first series of lace-receiving elements; and a connector designed to connect the second terminal end of the first lace with the second terminal end of the second lace at a point disposed between the bottommost lace-receiving element of the first series and the bottommost lace-receiving element of the second series.

2. The article of footwear recited in claim 1, wherein the first lace element of the second lace extends through a topmost lace-receiving element of the second series of lace-receiving elements located adjacent to an ankle opening of the upper and the second lace element of the second lace extends through a lace-receiving element of the second series of lace-receiving elements that is consecutive with the topmost lace-receiving element of the second series of lace-receiving elements.

3. The article of footwear recited in claim 1, wherein the unitary lace segment of the first lace and the unitary lace segment of the second lace are designed to be tied together in the form of a bow knot.

4. An article of footwear having an upper and a sole structure, the upper including a lacing system comprising:

a first series of lace-receiving elements extending in a longitudinal direction of the footwear;

a second series of lace-receiving elements extending in the longitudinal direction of the footwear, the second series being spaced from and parallel to the first series;

a first lace that comprises a first lace element and a second lace element that is coextensive with the first lace element, wherein the first lace has a first terminal end and a second terminal end opposite the first terminal end, wherein, at a point disposed adjacent to the second terminal end of the first lace, the first lace element and the second lace element of the first lace together extend through a bottommost lace-receiving element of the first series of lace-receiving elements;

a second lace that comprises a first lace element and a second lace element that coextensive with the first lace element, wherein the second lace has a first terminal end and a second terminal end opposite the first terminal end, wherein the first lace element and second lace element of the second lace converge at a converging point to form a unitary lace segment defining an end length of the second lace disposed adjacent to the first terminal end of the second lace, and the first lace element and the second lace element are inseparably joined to each other along the end length by a permanent connector interconnecting the first lace element and the second lace element along the end length such that the first lace element is inseparably and permanently connected to the second lace element along the end length, the first lace element and the second lace element are in direct contact with each other at the converging point, and the first lace element and the second lace element are parallel to each along the end length;

wherein, at a point disposed adjacent to the second terminal end of the first lace, the first lace element and the second lace element of the second lace together extend through a bottommost lace-receiving element of the second series of lace-receiving elements;

wherein the end length of the first lace and the end length of the second lace are designed to be tied together in the form of a bow knot; and a connector designed to connect the second terminal end of the first lace with the second terminal end of the second lace.

5. The article of footwear recited in claim 4, wherein the connector is a detachable connector.

6. The article of footwear recited in claim 5, wherein the connector has a clamshell configuration formed by a first connector portion and a second connector portion connected together by a hinge.

7. The article of footwear recited in claim 6, wherein the connector includes a first fastener element disposed on the first connector portion and a second fastener element disposed on the second connector portion, the first fastener element and the second fastener element fitting together to lock the first connector portion and the second connector portion around the first lace and the second lace.

8. The article of footwear recited in claim 4, wherein the connector is designed to receive and secure the first lace element and the second lace element of the first lace and the first lace element and the second lace element of the second lace.

9. The article of footwear recited in claim 4, wherein the connector connects the second terminal end of the first lace with the second terminal end of the second lace at a point disposed between the bottommost lace-receiving element of the first series and the bottommost lace-receiving element of the second series.

10. The article of footwear recited in claim 4, wherein the first lace element of the first lace extends from the bottommost lace-receiving element of the first series of lace-receiving elements to and through a first lace-receiving element of the second series of lace-receiving elements, the first lace-receiving element of the second series being consecutive with the bottommost lace-receiving element of the second series, and the first lace element is inseparably adhered to the second lace element along the end length.

11. The article of footwear recited in claim 10, wherein the second lace element of the first lace extends from the bottommost lace-receiving element of the first series of lace-receiving elements to and through a second lace-receiving element of the second series of lace-receiving elements, the second lace-receiving element of the first series being consecutive with the first lace-receiving element of the second series.

12. The article of footwear recited in claim 4, wherein the first lace element of the first lace extends through a topmost lace-receiving element of the second series of lace-receiving elements located adjacent to an ankle opening of the upper and the second lace element of the first lace extends through a lace-receiving element of the second series of lace-receiving elements that is consecutive with the topmost lace-receiving element of the first series of lace-receiving elements.

13. The article of footwear recited in claim 12, wherein the first lace element of the second lace extends through a topmost lace-receiving element of the first series of lace-receiving elements located adjacent to an ankle opening of the upper and the second lace element of the second lace extends through a lace-receiving element of the first series of lace-receiving elements that is consecutive with the topmost lace-receiving element of the second series of lace-receiving elements.

* * * * *